US005284740A

United States Patent [19]

Mihayashi et al.

[11] Patent Number: 5,284,740

[45] Date of Patent: Feb. 8, 1994

[54] SILVER HALIDE COLOR PHOTOGRAPHIC MATERIAL

[75] Inventors: Keiji Mihayashi; Yoshihiro Fujita; Masatoshi Goto, all of Kanagawa, Japan

[73] Assignee: Fuji Photo Film Co., Ltd., Kanagawa, Japan

[21] Appl. No.: 841,205

[22] Filed: Feb. 27, 1992

Related U.S. Application Data

[63] Continuation of Ser. No. 467,470, Jan. 19, 1990, abandoned.

[30] Foreign Application Priority Data

Jan. 20, 1989 [JP] Japan ..... 1-11254
Jan. 20, 1989 [JP] Japan ..... 1-11255
Jan. 20, 1989 [JP] Japan ..... 1-11256

[51] Int. Cl.[5] ..... G03C 1/46

[52] U.S. Cl. ..... 430/505; 430/611; 430/551; 430/506; 430/393; 430/567

[58] Field of Search ..... 430/611, 551, 505, 506, 430/393, 567

[56] References Cited

U.S. PATENT DOCUMENTS

| | | | |
|---|---|---|---|
| 4,607,004 | 8/1986 | Ikenoue et al. | 430/523 |
| 4,668,614 | 5/1987 | Tadaka et al. | 430/567 |
| 4,772,545 | 9/1988 | Nishiyama et al. | 430/611 |
| 4,845,017 | 7/1989 | Kishimoto et al. | 430/393 |
| 4,849,324 | 7/1989 | Aida et al. | 430/611 |
| 4,906,557 | 3/1990 | Becker et al. | 430/611 |
| 4,908,300 | 3/1990 | Koboshi et al. | 430/393 |
| 5,032,494 | 7/1991 | Kurematsu et al. | 430/393 |
| 5,085,979 | 2/1992 | Yamagami et al. | 430/505 |
| 5,104,775 | 4/1992 | Abe et al. | 430/393 |

FOREIGN PATENT DOCUMENTS

| | | | |
|---|---|---|---|
| 60-128443 | 7/1985 | Japan . | |
| 60-128443 | 7/1985 | Japan . | |
| 1132944 | 6/1986 | Japan | 430/611 |
| 2080963 | 2/1982 | United Kingdom | 430/611 |

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide color photographic material is described comprising a support having provided thereon one or more red-sensitive silver halide emulsion layers, one or more green sensitive silver halide emulsion layers and one or more blue-sensitive silver halide emulsion layers wherein the average silver iodide content of silver halide in all the silver halide emulsion layers is not less than 10 mol% and the silver halide color photographic material contains a compound represented by the following general formula (I):

$$Q—SM^1 \quad (I)$$

wherein Q represents a heterocyclic group having at least one group selected from $—SO_3M^2$, $—COOM^2$, —OH and $—NR^1R^2$ directly or indirectly connected thereto; $M^1$ and $M^2$ each represents a hydrogen atom, an alkali metal, a quaternary ammonium or a quaternary phosphonium; and $R^1$ and $R^2$ each represents a hydrogen atom or a substituted or unsubstituted alkyl group.

A process for processing the silver halide color photographic material is also described.

The silver halide color photographic material is improved in graininess and desilvering properties and has good resistance to natural and artificial radio-active rays.

24 Claims, No Drawings

SILVER HALIDE COLOR PHOTOGRAPHIC MATERIAL

This is a continuation of Application No. 07/467/470 filed Jan. 19, 1990, now abandoned.

FIELD OF THE INVENTION

The present invention relates to a silver halide color photographic light-sensitive material, and more particularly, to a silver halide color photographic material for photographing which has a high silver iodide content and is improved in its graininess and desilvering properties.

BACKGROUND OF THE INVENTION

In recent years, requirements of photographic light-sensitive materials, particularly those for photographing have become still more severe, and photographic light-sensitive materials of high sensitivity and fine graininess have been desired.

In order to achieve fine graininess, one means wherein a photographic light-sensitive material contains emulsion grains having a high silver iodide content and controlled grain structure is proposed and described, for example, in JP-A-60-143331 and JP-A-58-181037 (corresponding to U.S. Pat. Nos. 4,668,614 and 4,477,564, respectively) (the term "JP-A" as used herein means an "unexamined published Japanese patent application"). However, when this technique is applied to only one emulsion layer, the improvement in graininess is still insufficient. Further, there is a problem in that silver salt and/or silver are difficult to remove in a desilvering step, particularly in a fixing step as the silver iodide content increases as described in JP-A-62-7041.

It is also described that a photographic light-sensitive material in which the average silver iodide content of silver halide in all silver halide emulsion layers is not less than 8 mol% provides improved graininess in JP-A-60-128443. However, that silver iodide content is still insufficient to improve graininess. In addition, there are problems in the material's resistivity to irradiation of radioactive rays and its desilvering property.

On the other hand, photographic light-sensitive materials containing the compound according to the present invention are described, for example, in JP-A-62-89952 and JP-A-61-282841 (corresponding to GB-A-2,176,304 and U.S. Pat. No. 4,849,324, respectively). However, it has been believed that such a compound is preferably employed in combination with a silver halide emulsion having a low silver iodide content in view of its photographic properties such as sensitivity or fog and processing aptitude as described in the above patents.

However, it has become apparent to the applicants that an increase in fog, a decrease in sensitivity and degradation of graininess are very serious when a light-sensitive material containing an emulsion having a low silver iodide content is exposed to natural or artificial radioactive rays. Further, the desilvering property thereof is not good. It has been hitherto believed that a low silver iodide content is indispensable for shortening the desilvering step as described in JP-A-62-89963 (corresponding to U.S. Pat. No. 4,745,048).

SUMMARY OF THE INVENTION

An object of the present invention is to provide a silver halide color photographic material which is excellent in graininess.

Another object of the present invention is to provide a silver halide color photographic light-sensitive material in which an increase in fog and a decrease in sensitivity are small when it is exposed to natural or artificial radioactive rays.

A further object of the present invention is to provide a silver halide color photographic material which has a fast desilvering speed, particularly a fast fixing speed.

Other objects of the present invention will be apparent from the following detailed description and examples.

These objects of the present invention can be accomplished by a silver halide color photographic material comprising a support having provided thereon one or more red-sensitive silver halide emulsion layers, one or more green-sensitive silver halide emulsion layers and one or more blue-sensitive silver halide emulsion layers wherein the average silver iodide content of silver halide in all the silver halide emulsion layers is not less than 10 mol% and the silver halide color photographic material contains a compound represented by the following general formula (I):

$$Q—SM^1 \qquad (I)$$

wherein Q represents a heterocyclic group having at least one group selected from $—SO_3M^2$, $—COOM^2$, —OH and $—NR^1R^2$ directly or indirectly connected thereto; $M^1$ and $M^2$ each represents a hydrogen atom, an alkali metal, a quaternary ammonium or a quaternary phosphonium; and $R^1$ and $R^2$ each represents a hydrogen atom or a substituted or unsubstituted alkyl group.

DETAILED DESCRIPTION OF THE INVENTION

In the present invention, the term "average silver iodide content of silver halide in all the silver halide emulsion layers" means a value obtained by dividing the total molar amount of iodine (I) by the total molar amount of silver halide (not including metallic silver) in terms of silver (AgX) present in the light-sensitive material and multiplying the quotient by 100. In accordance with the present invention, the average silver iodide content should be not less than 10 mol%, and is preferably from 10.5 to 20.0 mol%, more preferably from 11.0 to 15.0 mol%.

According to the present invention, the color photographic light-sensitive material requires at least one red-sensitive silver halide emulsion layer, at least one green-sensitive silver halide emulsion layer and at least one blue sensitive emulsion layer. It is preferred that the red-, green- and blue-sensitive layers are composed of two or more layers having different speeds respectively, and more preferably, the green-sensitive layer and red sensitive layer are composed of three layers having different speeds respectively.

In the present invention, at least one emulsion layer has preferably an average silver iodide content of not less than 12 mol%, more preferably not less than 14 mol%.

It is preferable according to the present invention that the color photographic light-sensitive material has at least two layers containing silver halide emulsion grains in which silver iodobromide containing from 15 to 45 mol% of silver iodide exist in the form of a distinct stratified structure and the average silver iodide content in all grains is not less than 10 mol%.

The emulsion grains according to the present invention will now be explained in greater detail.

The distinct stratified structure described above can be determined by X-ray diffractometry. Examples of applying the X-ray diffractometry to silver halide grains are described, for example, in H. Hirsch; *Journal of Photographic Science*, Vol. 10, p. 129 et seq. (1962). The lattice constant is determined by the halide composition, and a diffraction peak appears at a diffraction angle satisfying Bragg's formula ($2d \sin\theta = n\lambda$: wherein d is a lattice constant, $\theta$ is an incidence angle, $\lambda$ is a wavelength and n is a positive integer).

A method for measuring X-ray diffraction is described in detail, for example, in *Kiso Bunseki Kagaku Koza*, Vol. 24, "X-sen Bunseki" (Kyoritsu Shuppan) and *X-sen Kaisetsu no Tebiki* (Rigaku Denki K. K.).

A standard measuring method is to use Cu as a target and determine the diffraction curve of a (220) crystal face of silver halide using K$\beta$ rays of Cu as a radiation source (tube voltage: 40 KV; tube current: 60 mA). In order to enhance the resolving power of the measuring apparatus, it is necessary to confirm the measuring accuracy by properly selecting the width of the slit (e.g., divergence slit, receiving slit, etc.), the time constant of the apparatus, the scanning speed of goniometer, and the recording speed using a standard sample such as silicon.

The distinct stratified structure in the present invention is defined as that when a curve of diffraction intensity versus diffraction angle with (220) crystal face of silver halide using K$\beta$ rays of Cu at diffraction angles ($2\theta$) ranging from 38° to 42° is obtained, at least two diffraction maxima of a diffraction peak corresponding to the higher iodide content layer containing from 15 to 45 mol% of silver iodide and a diffraction peak corresponding to the lower iodide content layer containing not more than 8 mol% of silver ratio of diffraction intensity corresponding to the higher iodide content layer to diffraction intensity of a peak corresponding to the lower iodide content layer is in a range from 1/10 to 3/1. The ratio of diffraction intensity is preferably in a range from 1/5 to 3/1, particularly preferably in a range from ⅓ to 3/1.

Of the emulsions having substantially two distinct stratified structures according to the present invention, those wherein the diffraction intensity of the minimum value between the two peaks is not more than 90% of that of the diffraction maximum (peak) which is the weaker or weakest of the two or more diffraction maxima are preferred. The value is more preferably not more than 80%, and particularly preferably not more than 60%.

The technique of analyzing a diffraction curve composed of two diffraction components is well known and is described, for example, in *Jikken Butsurigaku Koza*, Vol. 11, "Koshi Kekkan (Lattice Defect)" (Kyoritsu Shuppan).

It is preferable to analyze the curve by assuming it as a Gaussian or Lorentzian function and using a curve analyzer manufactured by Du Pont Co.

With emulsions containing two kinds of grains without a distinct stratified structure and having different halide compositions, two peaks appear in X-ray diffractometry.

Although such emulsions may be employed, emulsion grains having the distinct stratified structure described above are preferably employed.

In addition to the above-described X-ray diffractometry, the EPMA method (Electron-Probe Micro Analyzer method) can also be used to determine whether a particular silver halide emulsion is an emulsion in accordance with the present invention or an emulsion containing the above-described two types of silver halide grains.

In this method, a sample is prepared having well-dispersed silver halide grains so that each would not to come into contact with each other, and the sample is irradiated with electron beam. X-ray analysis by electron beam excitation permits elemental analysis of an extremely small portion.

This method permits determination of the halide compositions of individual grains by determining the intensity of the characteristic X-rays of silver and iodine emitted by the individual grains.

Confirmation of the halide composition of at least 50 grains according to the EPMA method is generally sufficient to determine whether a particular emulsion is an emulsion according to the present invention.

The emulsion used in the present invention is preferably as uniform as possible in iodide content among grains.

As to the iodide content distribution among grains measured by the EPMA method, the relative standard deviation is preferably not more than 50%, more preferably not more than 35%.

Another preferred iodide content distribution among grains is one wherein a logarithm of grain size is positively interrelated to an iodide content. In other words, the iodide content of the large size grains is high and the iodide content of the small size grains is low. An emulsion having such an interrelationship is preferred in view of graininess. The interrelation coefficient is preferably not less than 40%, more preferably not less than 50%.

In the core portion, the silver halide other than silver iodide may be any of silver chlorobromide and silver bromide, preferably with a higher content of silver bromide. The silver iodide content is ordinarily from 15 to 45 mol%, preferably from 25 to 45 mol%, more preferably from 30 to 45 mol%. The most preferred silver halide in the core portion is silver iodobromide containing from 30 to 45 mol% of silver iodide.

The outermost layer contains silver halide containing preferably up to 8 mol%, more preferably up to 6 mol%, of silver iodide.

In the outermost layer, the silver halide other than silver iodide may be any of silver chloride, silver chlorobromide and silver bromide, preferably with a higher content of silver bromide. The most preferred silver halide in the outermost layer is silver iodobromide containing from 0.1 to 6 mol% of silver iodide or silver bromide.

With an average halide composition of all grains having the distinct stratified structure preferably used in the present invention, a silver iodide content is preferably more than 10 mol%, more preferably from 11 to 20 mol%, further more preferably from 14 to 17 mol%.

The size of silver halide grains having the distinct stratified structure according to the present invention is ordinarily from 0.10 to 3.0 μm, preferably from 0.20 to 2.00 μm, more preferably from 0.30 to 1.7 μm, further more preferably from 0.40 to 1.4 μm.

The average grain size of silver halide grains used in the present invention is a geometric mean value of grain size which is well known in the field of art as described in T. H. James et al, *The Theory of the Photographic Process*, Third Edition, page 39, The Macmillan Company (1966). The grain size is indicated using a diameter corresponding to a sphere as described in Masabumi Arakawa, "Ryudo Sokutei Nyumon", *Funtai Kogaku Kaishi*, Vol. 17, pages 299 to 313 (1980), and can be measured by a method, for example, a coalter counter method, a single grain light scattering method and a laser light scattering method.

The silver halide grains used in the present invention may have a regular form ("normal crystal grains") such as hexahedral, octahedral, dodecahedral, and tetradecahedral, or an irregular form, such as spherical, pebble-like shape or tabular. Particularly, twin crystal grains having an aspect ratio of from 1.0 to 10, especially from 1.5 to 8, are preferably employed.

With normal crystal grains, those which have 50% or more of a (111) face are particularly preferred. With irregular form grains, too, those which have 50% or more of a (111) face are particularly preferable. The face ratio of a (111) face can be determined by KubelkaMunk's dye adsorption method. In this method, a dye is selected which preferentially adsorbs on either a (111) face or a (100) face, and which associates on the (111) face in a spectrally differentiable state from that on the (100) face. The selected dye thereby is added to an emulsion to be measured, and the spectrum for an amount of the dye added is studied in detail to determine the face ratio of the (111) face.

The emulsions preferably used in the present invention may have a broad grain size distribution, but emulsions with a narrow grain size distribution are preferred. Particularly in emulsions containing normal crystal grains, monodisperse emulsions in which 90% (by weight or number) of the total silver halide grains have grain sizes within the average grain size ±40%, more preferably ±30%, are preferred.

The effect of the present invention is most remarkably obtained with twin crystal grains. Tabular grains having two or more parallel twin faces are occuppied not less than 30%, preferably not less than 50%, more preferably not less than 70%, based on the projected area.

The emulsion containing silver halide grains having the distinct stratified structure preferably employed in the present invention may be prepared by combining proper processes selected from various conventional processes known in the field of silver halide photographic materials.

First, for the preparation of core grains, any of an acidic process, a neutral process, an ammoniacal process, etc. may be selected and, as for reacting a soluble silver salt with a soluble halide salt, any of a single jet process, a double jet process, combination thereof, etc. can be used.

As one type of double jet process, a process in which the pAg in the liquid phase in which silver halide is formed is kept constant, i.e., a controlled double jet process, may be employed. As another type of the double jet process, a triple jet process in which soluble halide salts of different compositions (for example, soluble silver salt, soluble bromide salt, and soluble iodide salt) are independently added may also be used. For preparation of core grains, a silver halide solvent such as ammonia, a rhodanate, a thiourea, a thioether, or an amine may be properly selected for use. Core grains desirably have a narrow grain size distribution, and the monodisperse core emulsions described above are particularly preferred. Emulsions wherein the halide composition, particularly an iodide content, of individual core grains is uniform are desirable. Whether the halide composition of individual core grains X-ray diffraction and the EPMA method described above. Core grains with uniform halide composition give a narrow and sharp diffraction peak width in X-ray diffraction.

After preparation of silver iodobromide seed crystals containing a high content of silver iodide, uniform silver iodobromide can also be prepared by a process of accelerating the rate of addition as the lapse of time as described in JP-B-48-36890 (the term "JP-B" as used herein means an "examined Japanese patent publication") by Irie and Suzuki, or by a process of increasing the concentrations of added solutions as the lapse of time as described in U.S. Pat. No. 4,242,445 to Saito. These processes give particularly preferable results. The process of Irie et al is a process of preparing photographic, slightly soluble inorganic crystals by double decomposition reaction through simultaneous addition of almost equal amounts of two or more aqueous solutions of inorganic salts in the presence of a protective colloid. The aqueous solutions of inorganic salts to be reacted are added at an addition rate not slower than a definite level and at a rate Q which is not more than the addition rate in proportion to the total surface area of the slightly soluble inorganic salt crystals under growing, i.e., not slower than $Q=\gamma$ and not faster than $Q=\alpha t^2+\beta t+\gamma$ (wherein $\alpha$, $\beta$ and $\gamma$ each is a fixed number decided by an experiment and t is time having passed from the beginning of reaction).

The Saito's process is a process of preparing silver halide crystals by simultaneously adding two or more aqueous solutions of inorganic salts in the presence of a protective colloid, in which the concentrations of the aqueous solutions of inorganic salts to be reacted are increased to such a degree that very few new crystal nuclei are produced during the crystal growth period.

In preparing silver halide grains having the distinct stratified structure preferably used in the present invention, the shell may be formed around the core grains without further treatment after core formation, but it is preferred to form the shell after washing the core emulsion to desalt the core grains.

Shell formation may be conducted according to various processes known in the field of silver halide photographic materials, with a double jet process being preferred. The above-described process of Irie et al and process of Saito are preferred for preparing emulsions containing grains having a distinct stratified structure.

For the preparation of silver halide grains having the distinct stratified structure in case of fine grain emulsion, conventional knowledge is useful but it is not sufficient for increasing completeness of the stratified structure. First, it is necessary to determine carefully a halide composition of a higher iodide content layer. It is known that silver iodide and silver bromide are different from each other in a thermodynamically stable crystal structure and mixed crystals thereof cannot always be formed in any ratio of composition. The ratio of composition in mixed crystal depends on temperature at the preparation of grains, but it is important to select an optimum ratio from a range from 30 to 45 mol% of silver iodide. It is presumed that the stable ratio of composition in mixed crystals exists in a range from 30 to 45 mol% of silver iodide while it depends on surroundings.

When a lower iodide content layer is formed around the higher iodide content layer, it is naturally important to select temperature, pI, pAg and condition of stirring, etc. Further, it is desired to select an amount of a protective colloid for the growth of the lower iodide content layer and to conduct the growth of lower iodide content layer in the presence of a compound which adsorbs on the surface of silver halide grain such as a spectral sensitizing dye, an antifogging agent and a stabilizer, etc. Further, a method wherein fine grain silver halide are added at the time of growth of the lower iodide content layer in place of addition of water-soluble silver salt and water-soluble alkali metal halide is effective.

As described above, when silver halide grains have the distinct stratified structure according to the present invention, two or more regions having different halide compositions substantially exist in the grains, and the central portion thereof is described as a core part and the surface portion thereof is described as a shell part.

The expression "two or more regions having different halide compositions substantially exist in the grains" also includes a case in which a third region (for example, a layer present between the central core part and the outermost shell part) is present in addition to the core part and the shell part.

However, if such a third region exists, it should be present in such a range that it has essentially no effect on the form of the two peaks (which is to say the two peaks corresponding to the part which has a high iodide content and the part which has a low iodide content) when an X-ray diffraction pattern is obtained in the manner as described above.

More specifically, if silver halide grains have a core part having a high iodide content, a middle part and a shell part having a low iodide content, two peaks and one minimum portion therebetween appear in their X-ray diffraction pattern, a ratio of diffraction intensity corresponding to the high iodide content part to diffraction intensity corresponding to the low iodide content part is in a range from 1/10 to 3/1, preferably from 1/5 to 3/1, particularly preferably from ⅓ to 3/1, and diffraction intensity of the minimum portion is not more than 90%, preferably not more than 80%, particularly preferably not more than 60%, of diffraction intensity of the peak which is the weaker of the two peaks, then the silver halide grains are those having substantially two distinct stratified structure.

A third region may similarly be present within the core part.

In the color photographic light-sensitive material according to the present invention, it is preferred that at least two emulsion layers containing the silver halide grains according to the present invention are present and in these emulsion layers the grains according to the present invention occupy preferably at least 50%, more preferably at least 70%, particularly preferably at least 90% of the total projected area of all silver halide grains.

Dyes which are employed in the growth of low iodide content layers include cyanine dyes, merocyanine dyes, complex cyanine dyes, complex merocyanine dyes, holopolar cyanine dyes, hemicyanine dyes, styryl dyes, and hemioxonol dyes. Particularly useful dyes are those belonging to cyanine dyes, merocyanine dyes, and complex merocyanine dyes. In these dyes, any of the nuclei ordinarily used as basic hetero ring nuclei in cyanine dyes can be used. That, is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; those in which these nuclei are fused with an alicyclic hydrocarbon ring; and those in which these nuclei are fused with an aromatic hydrocarbon ring, for example, an indolenine nucleus, a benzindolenine nucleus, an indole nucleus, a benzoxazole nucleus, a naphthoxazole nucleus, a benzothioazole nucleus, a naphthothiazole nucleus, a benzoselenazole nucleus, a benzimidazole nucleus, a quinoline nucleus, etc. can be used. These nuclei may be substituted at their carbon atoms.

The merocyanine dyes or complex merocyanine dyes can contain a ketomethylene nucleus, including 5- or 6-membered hetero ring nuclei such as a pyrazolin 5-one nucleus, a thiohydantoin nucleus, a 2-thiooxazolidine-2,4-dione nucleus, a thiohydantoin nucleus, a 2-thiooxazolidine-2,4-dione nucleus, a thiazolidine-2,4-dione nucleus, a rhodanine nucleus, a thiobarbituric acid nucleus, etc.

For example, compounds as described in *Research Disclosure*, No. 17643, Item IV, page 23 (December, 1978) and compounds as described in the literature cited therein can be employed.

Representative specific examples include compounds as described in JP-A-63-212932.

Antifogging agents and stabilizers are also useful compounds in the growth of low iodide content layer. Suitable compounds to be employed can be selected from those as described in the above mentioned *Research Disclosure.*

In the silver halide emulsion used in the present invention, silver halide grains having different compositions may be connected upon epitaxial junctions or silver halide grains may be connected with compounds other than silver halide such as silver thiocyanate, or lead oxide.

Further, a mixture of grains having a different crystal structure may be used.

The total coating amount of silver (including metal silver) in the photographic light-sensitive material according to the present invention is preferably from 3.0 $g/m^2$ to 8.0 $g/m^2$, more preferably from 4.0 $g/m^2$ to 7.5 $g/m^2$, further more preferably from 4.5 $g/m^2$ to 7 0 $g/m^2$. When the coating amount of silver is larger than the above described value problems may occur in desilvering property and resistance to radioactive rays. On the other hand the coating amount of silver is smaller than the above described value, graininess tends to deteriorate.

The thickness of layers in the photographic light-sensitive material according to the present invention is preferably from 13 μm to 25 μm, more preferably from 15 μm to 23 μm, further more preferably from 17 μm to 22 μm. When the thickness is greater than the highest value, desilvering property tends to deteriorate. On the other hand, when the thickness is less than the lowest value, problems of insufficient color density and a decrease in layer strength may occur.

The compound represented by the general formula (I) will be described in detail below.

$$Q—SM^1 \quad (I)$$

wherein Q represents a heterocyclic group having at least one group selected from $—SO_3M^2$, $—COOM^2$, —OH and $—NR^1R^2$ directly or indirectly connected thereto; $M^1$ and $M^2$ each represents a hydrogen atom, an alkali metal, a quaternary ammonium or a quaternary phosphonium; and $R^1$ and $R^2$ each represents a hydrogen atom or a substituted or unsubstituted alkyl group.

The compound represented by the general formula (I) is believed to flow out from the photographic light-sensitive material to a developing solution upon impartation of or increase in water solubility under a pH condition of the developing solution. In other words, when the compound represented by the general formula (I) is incorporated into the photographic light-sensitive material, it dissolves in a developing solution and may cause contamination thereof. Nevertheless, it is very surprising that changes in the photographic development properties are small and the formation of fog is little. Such unexpected results are believed to be based on the fact that the effect of the compound represented by the general formula (I) remarkably changes between the time that it is incorporated into the photographic light-sensitive material and the time it flows out into the developing solution. However, the precise behavior thereof is not yet certain and must be made clear by further investigations.

Silver halide color photographic materials containing a heterocyclic mercapto compound having at least one group selected from $-SO_3H$, $-COOH$, $-OH$ and $-NH_2$ which is included in the scope of photographic material comprising the compound represented by the general formula (I) used in the present invention are described in JP-B-58-9939 (corresponding to U.S. Pat. No. 4,021,248). However, there is no description whether the above described problems can be solved in case of development processing of the photographic material under a condition of a reduced replenishment amount of the developing solution.

Specific examples of the heterocyclic group represented by Q in the general formula (I) include an oxazole ring, a thiazole ring, an imidazole ring, a selenazole ring, a triazole ring, a tetrazole ring, a thiadiazole ring, an oxadiazole ring, a pentazole ring, a pyrimidine ring, a thiazine ring, a triazine ring, or a thiadiazine ring, or rings in which these rings are condensed with other carbon rings or hetero rings, for example, a benzothiazole ring, a benzotriazole ring, a benzimidazole ring, a benzoxazole ring, a benzoselenazole ring, a naphthoxazole ring, a triazaindolidine ring, a diazaindolidine ring, or a tetrazaindolidine ring.

Of the mercapto heterocyclic compounds represented by the general formula (I), those represented by the general formula (II) or (III) are particularly preferred.

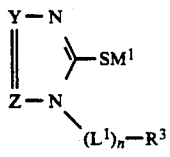
(II)

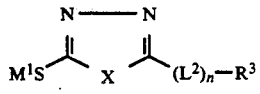
(III)

In the general formula (II), Y and Z each represents a nitrogen atom or $CR^4$ (wherein $R^4$ represents a hydrogen atom, a substituted or unsubstituted alkyl group or a substituted or unsubstituted aryl group); $R^3$ represents an organic group substituted with at least one group selected from $-SO_3M^2$, $-COOM^2$, $-OH$ and $-NR^1R^2$ (wherein $M^2$, $R^1$ and $R^2$ each has the same meaning as defined above), with the organic group being more specifically an alkyl group having from 1 to 20 carbon atoms (for example, methyl, ethyl, propyl, hexyl, dodecyl or octadecyl) or an aryl group having from 6 to 20 carbon atoms (for example, phenyl or naphthyl); $L^1$ represents a linking group selected from $-S-$, $-O-$,

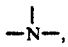

$-CO-$, $-SO-$ and $-SO_2-$; and n represents 0 or 1.

The alkyl group or aryl group may be substituted with one or more substituents, for example, a halogen atom (for example, fluorine, chlorine or bromine), an alkoxy group (for example, methoxy or methoxyethoxy), an aryloxy group (for example, phenoxy), an alkyl group (when $R^3$ is an aryl group), an aryl group (when $R^3$ is an alkyl group), an amido group (for example, acetamido or benzoylamino), a carbamoyl group (for example, unsubstituted carbamoyl, phenylcarbamoyl or methylcarbamoyl), a sulfonamido group (for example, methanesulfonamido or phenylsulfonamido), a sulfamoyl group (for example, unsubstituted sulfamoyl, methylsulfamoyl or phenylsulfamoyl), a sulfonyl group (for example, methylsulfonyl or phenylsulfonyl), a sulfinyl group (for example, methyl sulfinyl or phenylsulfinyl), a cyano group, an alkoxycarbonyl group (for example, methoxycarbonyl), an aryloxycarbonyl group (for example, phenoxycarbonyl), or a nitro group.

When two or more substituents selected from $-SO_3M^2$, $-COOM^2$, $-OH$ and $-NR^1R^2$ are present in $R^3$, they may be the same or different.

$M^1$ has the same meaning as defined in the general formula (I).

In the general formula (III), X represents a sulfur atom, an oxygen atom or

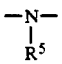

(wherein $R^5$ represents a hydrogen atom, a substituted or unsubstituted alkyl group or a substituted or unsubstituted aryl group); $L^2$ represents $-CONR^6-$, $-NR^6CO-$, $-SO_2NR^6-$, $-NR^6SO_2-$, $-OCO-$, $-COO-$, $-S-$, $-NR^6-$, $-CO-$, $-SO-$, $-OCOO-$, $-NR^6CONR^7-$, $-NR^6COO-$, $-OCONR^6-$ or $-NR^6SO_2NR^7$ (wherein $R^6$ and $R^7$ each represents a hydrogen atom, a substituted or unsubstituted alkyl group or a substituted or unsubstituted aryl group).

$R^3$ and $M^1$ each has the same meaning as defined in the general formula (I) or (II).

n represents 0 or 1.

Substituents for the alkyl group or aryl group represented by $R^4$, $R^5$, $R^6$ or $R^7$ are the same as those described for $R_3$.

In the general formulae, it is particularly preferred that $R^3$ is $-SO_3M^2$ or $-COOM^2$.

Specific examples of the compound represented by the general formula (I) preferably used in the present invention are set forth below, but the present invention should not be construed as being limited thereto.

(1)
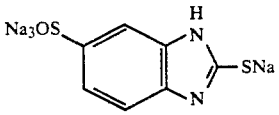
(2)
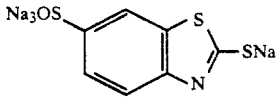
(3)
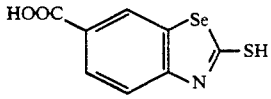
(4)
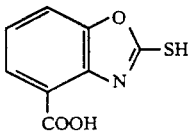
(5)
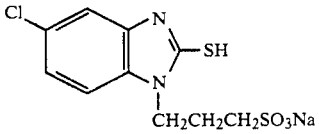
(6)
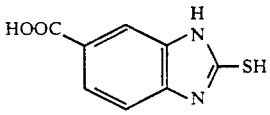
(7)
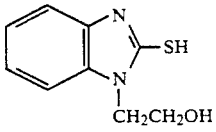
(8)
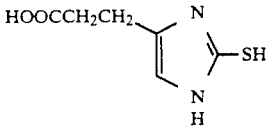
(9)
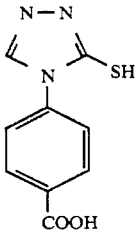
(10)
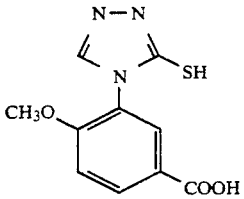
-continued
(11)
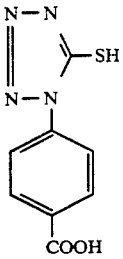
(12)
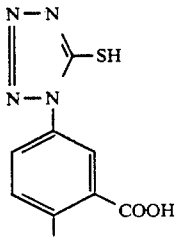
(13)
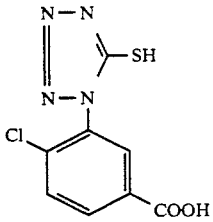
(14)
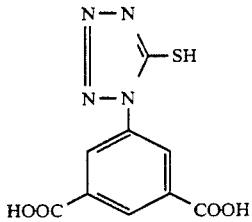
(15)
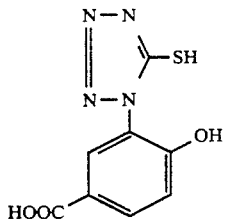
(16)
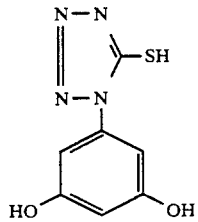

-continued
(17)
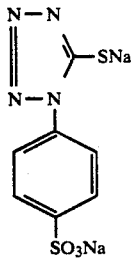
(18)
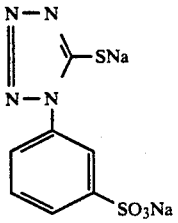
(19)
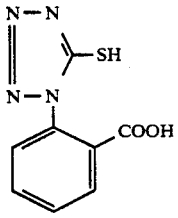
(20)
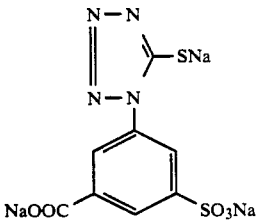
(21)
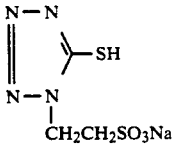
(22)
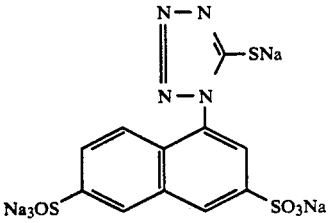
(23)
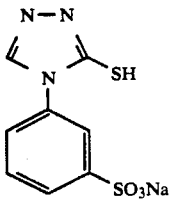
-continued
(24)
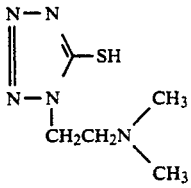
(25)
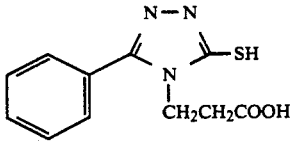
(26)
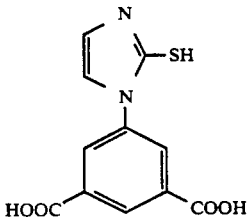
(27)
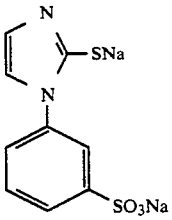
(28)
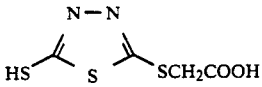
(29)
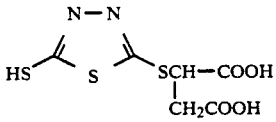
(30)
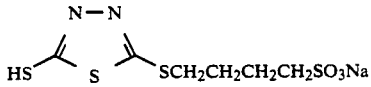
(31)
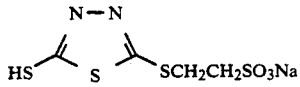
(32)
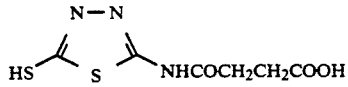
(33)
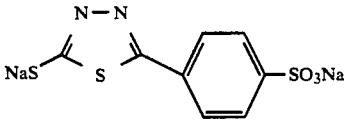
(34)
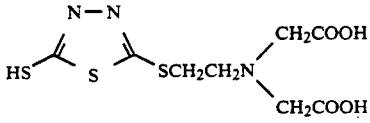

-continued (35)

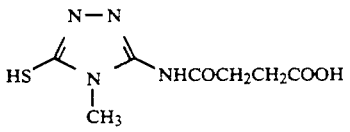

(36)

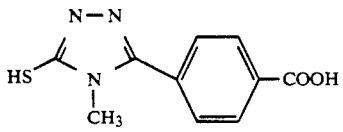

(37)

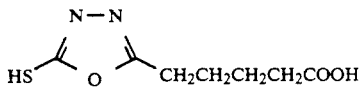

(38)

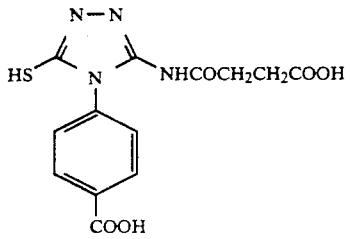

(39)

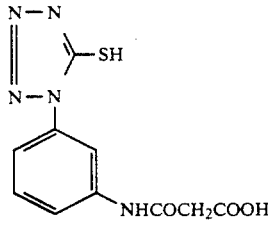

The compounds represented by the general formula (I) are known and can be synthesized according to methods as described in the following literatures:

U.S. Pat. Nos. 2,585,388 and 2,541,924, JP-B-42-21842, JP-A-53-50169, British Patent 1,275,701, D. A. Berges et al, *Journal of Heterocyclic Chemistry*, Vol. 15, No. 981. *The Chemistry of Heterocyclic Compounds, Imidazole and Derivatives*, Part I, pages 336 to 339 (1978), *Chemical Abstract*, Vol. 58, No. 7921, page 394 (1963), E. Hoggarth, *Journal of Chemical Society*, pages 1160 to 1167 (1949), S. R. Saudler and W. Karo, *Organic Functional Group Preparation*, pages 312 to 315, Academic Press (1968), M. Chamdon et al, *Bulletin de la Societe Chimique de France*, page 723 (1954), D. A. Shirley and D. W. Alley, *J. Amer. Chem. Soc.*, Vol. 79, page 4922 (1954), A. Wohl and W. Marchwald, *Ber.*, Vol. 22, page 568 (1889), *J. Amer. Chem. Soc.*, Vol. 44, page 1502 to 1510, U.S. Pat. No. 3,017,270, British Patent 940,169, JP-B-49-8334, JP-A-55-59463, *Advanced in Heterocyclic Chemistry*, Vol. 9, pages 165 to 209 (1968), West German Patent 2,716,707, *The Chemistry of Heterocyclic Compounds, Imidazole and Derivatives* Vol. 1, page 384, *Org. Synth.*, IV, page 569 (1963), Ber. Vol. 9, page 465 (1876), *J. Amer. Chem. Soc.*, Vol. 45, page 2390 (1923), JP-A-50-89034, JP-A-53-28426, JP-A-55-21007 and JP-B-40-28496.

The compound represented by the general formula (I) can be incorporated into a silver halide emulsion layer or a hydrophilic colloid layer (for example, an intermediate layer, a surface protective layer, a yellow filter layer or an anti-halation layer). It is preferred to incorporated it into a silver halide emulsion layer or an adjacent layer thereto.

The amount of the compound is ordinarily from $1\times10^{-7}$ to $1\times10^{-3}$ mol/m$^2$, preferably, from $5\times10^{-7}$ to $1\times10^{-4}$ mol/m$^2$, more preferably from $1\times10^{-6}$ to $3\times10^{-5}$ mol/m$^2$.

The color photographic light-sensitive material of the present invention has at least one blue-sensitive silver halide emulsion layer, at least one green-sensitive silver halide emulsion layer and at least one red-sensitive silver halide emulsion layer on a support. The number of silver halide emulsion layers and light-insensitive layers and the order thereof are not particularly restricted. One typical example is a silver halide photographic material comprising a support having thereon at least one blue-sensitive layer group, at least one green-sensitive layer group and at least one and red-sensitive layer group each composed of a plurality of silver halide emulsion layers which have substantially the same color sensitivity but different speeds. In a multilayer silver halide color photographic material, unit light-sensitive layers are generally provided in the order of a red-sensitive layer, a green-sensitive layer and a blue-sensitive layer from the support side on the support. The order of these layers can be varied depending on the purpose. Further, there may be a layer structure wherein between two layers having the same color sensitivity, a light-sensitive layer having a different color sensitivity is sandwiched.

Between the above described silver halide light-sensitive layers or as the uppermost layer or the undermost layer, various light-insensitive layers such as an intermediate layer can be provided.

Into such an intermediate layer, couplers and DIR compounds as described, for example, in JP-A-61-43748, JP-A-59-113438, JP-A-59-113440, JP-A-61-20037 and JP A-61-20038 may be incorporated. Further, the intermediate layer may contain color stain preventing agents conventionally employed.

The plurality of silver halide emulsion layers which constitute the unit light-sensitive layer preferably have a two-layer construction consisting of a high speed emulsion layer and a low speed emulsion layer as described, for example, in West German Patent 1,121,470 and British Patent 923,045. It is preferred that these layers are disposed in order of increasing speed from the support side. Further, a light-insensitive layer may be provided between the silver halide emulsion layers. Moreover, a low speed emulsion layer may be provided further away from the support and a high speed emulsion layer may be provided on the side closest to the support as described, for example, in JP-A-57-112751, JP-A-62-200350, JP-A-62-206541 and JP-A-62-206543.

Specific examples of the layer construction include an order of a low speed blue-sensitive layer (BL)/a high speed blue-sensitive layer (BH)/a high speed green-sensitive layer (GH)/a low speed green-sensitive layer (GL)/a high speed red-sensitive layer (RH)/a low speed red-sensitive layer (RL) from the furthest from the support, an order of BH/BL/GL/GH/RH/RL, or an order of BH/BL/GH/GL/RL/RH.

Further, an order of a blue-sensitive layer/GH/RH/GL/RL from the furthest from the support as described in JP-B-55-34932 may be employed. Moreover, an order of a blue-sensitive layer/GL/RL/GH/RH from the furthest from the support as described in JP-A-56-25738 and JP-A-62-63936 may also employed.

Furthermore, a layer construction of three layers having different speeds comprising an upper silver halide emulsion layer having the highest speed, an intermediate silver halide emulsion layer having a lower speed than that of the upper layer, and an under silver halide emulsion layer having a lower speed than that of the intermediate layer in order of increasing speed from the support as described in JP-B-49-15495 is also employed. In the case wherein the unit light-sensitive layer of the same color sensitivity is composed of three layers having different speeds, an order of an intermediate speed emulsion layer/a high speed emulsion layer/a low speed emulsion layer from the furthest from the support may be employed as described in JP-A-59-202464.

As described above, various layer constructions and dispositions may be appropriately selected depending on the purpose of the photographic light-sensitive material.

Silver halide other than the above described silver halide contained in the photographic emulsion layers of the photographic light-sensitive material according to the present invention is silver iodobromide, silver iodochloride or silver iodochlorobromide each containing about 30 mol% or less of silver iodide. Silver iodobromide or silver iodochlorobromide each containing from about 2 mol% to about 25 mol% of silver iodide is particularly preferred.

Silver halide grains in the silver halide emulsion may have a regular crystal structure, for example, a cubic, octahedral or tetradecahedral structure, an irregular crystal structure, for example, a spherical or tabular structure, a crystal defect, for example, a twin plane, or a composite structure thereof.

A grain size of silver halide may be varied and may include from fine grains of about 0.2 μm or less to large size grains of about 10 μm of a diameter of the projected area. Further, a polydisperse emulsion and a monodisperse emulsion may be used.

The silver halide photographic emulsion which can be used in the present invention can be prepared used known methods, for example, those described in *Research Disclosure*, No. 17643 (December, 1978), pages 22 to 23, "I. Emulsion Preparation and Types" and ibid., No. 18716 (November, 1979), page 648, P. Glafkides, *Chimie et Physique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964).

Monodisperse emulsions as described, for example, in U.S. Pat. Nos. 3,574,628 and 3,655,394, and British Patent 1,413,748 are preferably used in the present invention.

Further, tabular silver halide grains having an aspect ratio of about 5 or more can be employed in the present invention. The tabular grains may be easily prepared by the method as described, for example, in Gutoff, *Photographic Science and Engineering*, Vol. 14, pages 248 to 257 (1970), U.S. Pat. Nos. 4,434,226, 4,414,310, 4,433,048 and 4,439,520, and British Patent 2,112,157.

Crystal structure of silver halide grains may be uniform, composed of different halide compositions between the inner portion and the outer portion, or may have a stratified structure.

Further, silver halide emulsions in which silver halide grains having different compositions are connected upon epitaxial junctions or silver halide emulsions in which silver halide grains are connected with compounds other than silver halide, such as silver thiocyanate, or lead oxide, may also be employed.

Moreover, a mixture of grains having a different crystal structure may be used.

The silver halide emulsions used in the present invention are usually conducted with physical ripening, chemical ripening and spectral sensitization. Various kinds of additives which can be employed in these steps are described in *Research Disclosure*, No. 17643, (December, 1978) and ibid., No. 18716 (November, 1979) and concerned items thereof are summarized in the table shown below.

Further, known photographic additives which can be used in the present invention are also described in the above mentioned literatures and related items thereof are summarized in the table below.

| Kind of Additives | RD 17643 | RD 18716 |
|---|---|---|
| 1. Chemical Sensitizers | Page 23 | Page 648, right column |
| 2. Sensitivity Increasing Agents | | Page 648, right column |
| 3. Spectral Sensitizers and Supersensitizers | Pages 23 to 24 | Page 648, right column to page 649, right column |
| 4. Whitening Agents | Page 24 | |
| 5. Antifoggants and Stabilizers | Pages 24 to 25 | Page 649, right column |
| 6. Light-Absorbers, Filter Dyes and Ultraviolet Ray Absorbers | Pages 25 to 26 | Page 649, right column to page 650, left column |
| 7. Antistaining Agents | Page 25, right column | Page 650, left column to right column |
| 8. Dye Image Stabilizers | Page 25 | |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 to 27 | Page 650, right column |
| 13. Antistatic Agents | Page 27 | Page 650, right column |

Further, in order to prevent degradation of photographic property due to formaldehyde gas, it is preferred to add a compound capable of reacting with formaldehyde to fix it, as described in U.S. Pat. No. 4,411,987 and 4,435,503, to the photographic light-sensitive material.

In the present invention, various color couplers can be employed and specific examples thereof are described in the patents cited in *Research Disclosure*, No. 17643, "VII-C" to "VII-G".

As yellow couplers used in the present invention, for example, those described in U.S. Pat. No. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249,473A are preferred.

As magenta couplers used in the present invention, 5-pyrazolone type and pyrazoloazole type compounds are preferred. Magenta couplers described, for example, in U.S. Pat. No. 4,310,619 and 4,351,897, European Patent 73,636, U.S. Pat. Nos. 3,061,432 and 3,725,067, *Research Disclosure*, No. 24220 (June, 1984), JP-A-60-33552, *Research Disclosure*, No. 24230 (June, 1984), JP-A-60-43659, JP-A-61-72238, JP-A-60-35730, JP-A-

55-118034, JP-A-60-18951, and U.S. Pat. Nos. 4,500,630, 4,540,654 and 4,556,630, and WO(PCT) 88/04795 are particularly preferred.

As cyan couplers used in the present invention, phenol type and naphthol type couplers are exemplified. Cyan couplers as described, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred.

As colored couplers for correcting undesirable absorptions of dyes formed, those described, for example, in *Research Disclosure*, No. 17643, "VII-G", U.S. Pat. No. 4,163,670, JP-B-57-39413, U.S. Pat. Nos. 4,004,929 and 4,138,258, and British Patent 1,146,368 are preferably employed. Also, couplers for correcting undesirable absorption of dyes formed, which release a fluorescent dye at the time of coupling, described in U.S. Pat. No. 4,774,181, or couplers having as a releasing group a dye precursor capable of forming a dye upon a reaction with a developing agent, described in U.S. Pat. No. 4,777,120, are preferably employed.

As couplers capable of forming appropriately diffusible dyes, those described, for example, in U.S. Pat. No. 4,366,237, British Patent 2,125,570, European Patent 96,570, and West German Patent Application (OLS) No. 3,234,533 are preferably employed.

Typical examples of polymerized dye forming couplers are described, for example, in U.S. Pat. Nos. 3,451,820, 4,080,211, 4,367,282, 4,409,320 and 4,576,910, and British Patent 2,102,173.

Couplers capable of releasing a photographically useful moiety during the course of coupling can be also employed preferably in the present invention. As DIR couplers capable of releasing a development inhibitor, those described, for example, in the patents cited in *Research Disclosure*, No. 17643, "VII-F" described above, JP-A-57-151944, JP-A-57-154234, JP-A-60-184248, JP-A-63-37346 and U.S. Pat. Nos. 4,248,962 and 4,782,012 are preferred.

As couplers which release imagewise a nucleating agent or a development accelerator at the time of development, those described, for example, in British Patents 2,097,140 and 2,131,188, JP-A-59-157638, and JP-A-59-170840 are preferred.

Furthermore, competing couplers such as those described, for example, in U.S. Pat. No. 4,130,427; polyequivalent couplers such as those described, for example, in U.S. Pat. Nos. 4,283,472, 4,338,393 and 4,310,618; DIR redox compound or DIR coupler releasing couplers or DIR coupler or DIR redox compound releasing redox compound such as those described, for example, in JP-A-60-185950 and JP-A-62-24252; couplers capable of releasing a dye which turns to a colored form after being released such as those described, for example, in European Patent 173,302A; bleach accelerator releasing couplers such as those described, for example, in *Research Disclosure*, No. 11449, ibid, No. 24241 and JP-A-61-201247; ligand releasing couplers such as those described, for example, in U.S. Pat. No. 4,553,477; couplers capable of releasing a leuco dye such as those described, for example, in JP-A-63-75747; and couplers capable of releasing a fluorescent dye such as those described, for example, in U.S. Pat. No. 4,774,181 may be employed in the photographic light-sensitive material of the present invention.

The couplers which can be used in the present invention can be dispersed into the photographic light-sensitive material according to various known dispersing methods.

Suitable examples of organic solvents having a high boiling point which can be employed in an oil droplet-in-water type dispersing method are described, for example, in U.S. Pat. No. 2,322,027.

Specific examples of the organic solvents having a high boiling point not less than 175° C. at normal pressure and can be employed in the oil droplet in-water type dispersing method include phthalic acid esters (for example, dibutyl phthalate, dicyclohexyl phthalate, di-2-ethylhexyl phthalate, didecyl phthalate, bis(2,4-di-tert-amylphenyl)phthalate, bis(2,4-di-tert-amylphenyl-)isophthalate, or bis(1,1-diethylpropyl)phthalate, phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, or di-2-ethylhexyl phenylphosphonate), benzoic acid esters (for example, 2-ethylhexyl benzoate, dodecyl benzoate, or 2-ethylhexyl-p-hydroxybenzoate), amides (for example, N,N-diethyldodecanamide, N,N-diethyllaurylamide, or N-tetradecylpyrrolidone), alcohols or phenols (for example, isostearyl alcohol, or 2,4-di-tert-amylphenol), aliphatic carboxylic acid esters (for example, bis(2-ethylhexyl)sebacate, dioctyl azelate, gycerol tributyrate, isostearyl lactate, or trioctyl citrate), aniline derivatives (for example, N,N-dibutyl-2-butoxy-5-tertoctylaniline), and hydrocarbons (for example, paraffin, dodecylbenzene, or diisopropylnaphthalene).

Further, an organic solvent having a boiling point at least about 30° C. and preferably having a boiling point above 50° C. but below about 160° C. can be used as an auxiliary solvent. Typical examples of the auxiliary solvents include ethyl acetate, butyl acetate, ethyl propionate, methyl ethyl ketone, cyclohexanone, 2-ethoxyethyl acetate, or dimethylformamide.

The processes and effects of latex dispersing methods and the specific examples of latexes for loading are described, for example, in U.S. Pat. No. 4,199,363, West German Patent Application (OLS) Nos. 2,541,274 and 2,541,230.

The present invention can be applied to various color photographic light-sensitive materials, and typical examples thereof include color negative films for general use or cinematography, color reversal films for slides or television, color papers, color positive films, and color reversal papers.

Suitable supports which can be used in the present invention are described, for example, in *Research Disclosure*, No. 17643, page 28 and ibid., No. 18716, page 647, right column to page 648, left column, as mentioned above.

It is preferred that the total layer thickness of all hydrophilic colloid layers on the emulsion layer side of the photographic light-sensitive material according to the present invention is not more than 28 μm and a layer swelling rate of $T_{\frac{1}{2}}$ is not more than 30 seconds. The layer thickness means a thickness of layer measured under a temperature of 25° C. and a relative humidity of 55% for 2 days. The layer swelling rate of $T_{\frac{1}{2}}$ is determined according to a known method in the field of the art. For instance, the degree of swelling can be measured using a swellometer of the type described in A. Green, *Photogr. Sci. Eng.*, Vol. 19, No. 2, page 124 to 129, and $T_{\frac{1}{2}}$ is defined as the time necessary for reaching a layer thickness to the half of a saturated layer thickness which is 90% of the maximum swelling layer thickness obtained when treated in a color developing solution at 30° C. for 3 minutes and 15 seconds.

The layer swelling rate of $T_{\frac{1}{2}}$ can be controlled by adding a hardening agent to a qelatin binder or changing the aging condition after coating.

The rate of swelling is preferably from 150% to 400%. The rate of swelling can be calculated by a formula of (maximum swelling layer thickness - layer thickness)/layer thickness wherein the maximum swelling layer thickness has the same meaning as defined above.

The color photographic light-sensitive material according to the present invention can be subjected to development processing in a conventional manner as described in *Research Disclosure*, No. 17643, pages 28 to 29 and ibid., No. 18716, page 651, left column to right column, as mentioned above.

A color developing solution which can be used in development processing of the color photographic light-sensitive material according to the present invention is an alkaline aqueous solution containing preferably an aromatic primary amine type color developing agent as its main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, or sulfate, hydrochloride or p-toluenesulfonate thereof.

Two or more kinds of color developing agents may be employed in a combination thereof, depending on the purpose.

The color developing solution can ordinarily contain pH buffering agents, such as carbonates, borates or phosphates of alkali metals; and development inhibitors or anti-fogging agents such as bromides, iodides, benzimidazoles, benzothiazoles, or mercapto compounds. Further, if necessary, the color developing solution may contain various preservatives, such as hydroxylamine, diethylhydroxylamine, sulfites, hydrazines, phenylsemicarbazides, triethanolamine, catechol sulfonic acids, or triethylenediamine(1,4-diazabicyclo[2,2,2]octane); organic solvents such as ethyleneglycol, or diethylene glycol; development accelerators such as benzyl alcohol, polyethylene glycol, quarternary ammonium salts, or amines; dye forming couplers; competing couplers; fogging agents such as sodium borohydride; auxiliary developing agents such as 1-phenyl-3-pyrazolidone; viscosity imparting agents; and various chelating agents such as aminopolycarboxylic acids, aminopolyphosphonic acids, alkylphosphonic acids, or phosphonocarboxylic acids. Representative examples of the chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and salts thereof.

In case of reversal processing, color development is usually conducted after black-and-white development. In a black-and-white developing solution, known black-and-white developing agents, for example, dihydroxybenzenes such as hydroquinone, 3-pyrazolidones such as 1-phenyl-3-pyrazolidone, or aminophenols such as N-methyl-p-aminophenol ma be employed individually or in combination.

The pH of the color developing solution or the black-and-white developing solution is usually in a range from 9 to 12. Further, the amount of replenishment for the developing solution can be varied depending on color photographic light-sensitive materials to be processed, but is generally not more than 3 liters per square meter of the photographic light-sensitive material. The amount of replenishment can be reduced to not more than 500 ml by decreasing the bromide ion concentration in the replenisher. In the case of reducing the amount of replenishment, it is preferred to prevent evaporation and aerial oxidation of the processing solution by reducing the area of the processing tank which is in contact with the air. Further, the amount of replenishment can be reduced by using a means which restrains accumulation of bromide ion in the developing solution.

The processing time for color development is usually selected in a range from 2 minutes to 5 minutes. However, it is possible to reduce the processing time by performing the color development at high temperature and high pH using a high concentration of the color developing agent.

After color development, the photographic emulsion layers are usually subjected to a bleach processing. The bleach processing can be performed simultaneously with a fix processing (bleach-fix processing), or it can be performed independently from the fix processing. Further, for the purpose of a rapid processing, a processing method wherein, after a bleach processing a bleach-fix processing is conducted may be employed. Moreover, depending on the purpose, it is possible to process using a continuous two tank bleach-fixing bath, to carry out fix processing before bleach-fix processing, or to conduct bleach processing after bleach-fix processing.

Examples of bleaching agents which can be employed in the bleach processing or bleach-fix processing include: compounds of a multivalent metal such as iron(III), cobalt(III), chromium(VI), or copper(II); peracids; quinones; or nitro compounds. Representative examples of the bleaching agents include: ferricyanides; dichloromates; organic complex salts of iron(III) or cobalt(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, or glycol ether diaminetetraacetic acid), or complex salts of organic acids (such as citric acid, tartaric acid, or malic acid); persulfates; bromates; permanganates; or nitrobenzenes. Of these compounds, iron(III) complex salts of aminopolycarboxylic acids represented by iron(III) complex salt of ethylenediaminetetraacetic acid and persulfates are preferred in view of rapid processing and less environmental pollution. Furthermore, iron(III) complex salts of aminopolycarboxylic acids are particularly useful in both bleaching solutions and bleach-fixing solutions.

The pH of the bleaching solution or bleach-fixing solution containing an iron(III) complex salt of aminopolycarboxylic acid is usually in a range from 5.5 to 8. For the purpose of rapid processing, it is possible to process at a pH lower than the above described range.

The pH, particularly of the bleaching solution using a ferric (iron(III)) complex of 1,3-diaminopropanetetraacetic acid is, preferred to be controlled in the range of from 3.5 to 5.8, and most preferred is to be controlled in the range of from 4.0 to 5.3. The bleaching solution the pH of which is controlled to fall in the preferable range less suffers bleach fogging, and possesses excellent desilvering properties.

Further, the total amount of the ferric complex of aminopolycarboxylic acid to be added is, preferably in the range of from 0.01 to 1.0 mol/l, more preferably, from 0.1 to 0.7 mol/l in the case of bleaching solution; and in the case of a bleach-fixing solution, the amount is preferably from 0.05 to 0.5 mol/l, more preferably from 0.1 to 0.4 mol/l.

In the bleaching solution, the bleach-fixing solution or a prebath thereof, a bleach accelerating agents can be used, if desired. Specific examples of suitable bleach accelerating agents include compounds having a mercapto group or a disulfide bond described, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure*, No. 17129 (July 1978); thiazolidine derivatives described, for example, in JP-A-50-140129; thiourea derivatives described, for example, in JP-B-45-8506, JP-A-52-20832, JP-A-53-32735 and U.S. Pat. No. 3,706,561; iodides described, for example, in West German Patent 1,127,715 and JP-A-58-16235; polyoxyethylene compounds described, for example, in West German Patents 966,410 and 2,748,430; polyamine compounds as described, for example, in JP-B-45-8836; compounds as described, for example, in JP-A-49-42434, JP-A-49-59644, JP-A-53-94927, JP-A-54-35727, JP-A-55-26506, and JP-A-58-163940; and bromide ions. Of these compounds, the compounds having a mercapto group or a disulfide bond are preferred in view of their large bleach accelerating effects. Particularly, the compounds described in U.S. Pat. No. 3,893,858, West German Patent 1,290,812 and JP-A-53-95630 are preferred. Further, the compounds described in U.S. Pat. No. 4,552,834 are also preferred. These bleach accelerating agents may be incorporated into the color photographic light-sensitive material. Particularly preferred is a compound represented by the general formula (IV) below, or a salt thereof from the viewpoint of higher bleaching acceleration and its excellent stability in the bleach-fixing solution capable of continuously accelerating the bleaching for a long period of time.

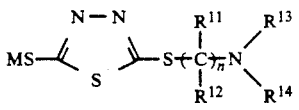
(IV)

wherein $R^{11}$ and $R^{12}$ each represents a hydrogen atom, a hydroxyl group, an amino group (for example, amino, dimethylamino, diethylamino and methylamino), a carboxyl group, a sulfo group or an alkyl group; $R^{13}$ and $R^{14}$ each represents hydrogen atom, an alkyl group, or an acyl group, and $R^{13}$ together with $R^{14}$ may link to form a ring; M represents a hydrogen atom, an alkali metal atom (for example, sodium and potassium), or an ammonium group; and n represents an integer from 2 to 5, and preferably represents 2 and 3.

$R^{11}$, $R^{12}$, $R^{13}$ and $R^{14}$ each preferably represents a substituted or unsubstituted alkyl group having from 1 to 5 carbon atoms in its alkyl moiety (for example, methyl, ethyl and propyl). Examples of substituents include a carboxyl group, a hydroxyl group, a sulfo group, an amino group (for example, amino and dimethylamino), an alkoxy group (for example, methoxy and ethoxy), a sulfonyl group (for example, methanesulfonyl and ethanesulfonyl), a carbamoyl group (for example, carbamoyl and methylcarbamoyl), a sulfamoyl group (for example, sulfamoyl and methylsulfamoyl), an amido group (for example, acetylamino), a sulfonamido group (for example, methanesulfonylamino), an alkoxycarbonyl group (for example, methoxycarbonyl, and ethoxycarbonyl), a cyano group or a halogen atom (for example, chlorine and bromine).

As acyl groups represented by $R^{13}$ and $R^{14}$, preferred are those having 3 or less carbon atoms (for example, acetyl). Mentioned as rings formed by linking of $R^{13}$ and $R^{14}$ include a pyrrole ring, a pyrrolidine ring, a pyrazole ring, an imidazole ring, a triazole ring, a morpholine ring, a piperidine ring, a pyridine ring, a pyrimidine ring, and a pyrazine ring.

In the compound represented by the general formula (IV), preferably used in the present invention are those in which n represents 1 or 2; $R^{13}$ and $R^{14}$ each represents a hydrogen group or an alkyl group having 1 or 2 carbon atoms, and $R^{13}$ and $R^{14}$ may link to form an imidazole ring, a triazole ring, or a pyridine ring.

Specific examples of the compound represented by the general formula (IV) preferably used in the present invention are set forth below, but the present invention should not be construed as being limited thereto.

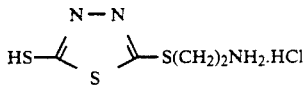
(1)

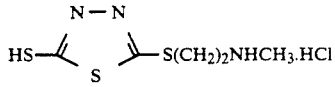
(2)

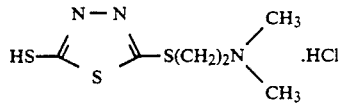
(3)

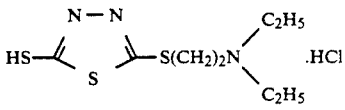
(4)

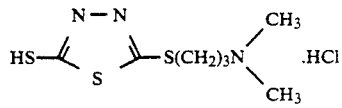
(5)

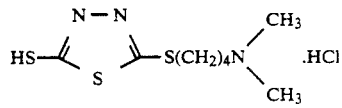
(6)

-continued
(7)
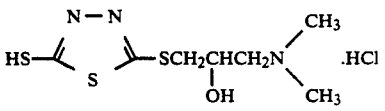
(8)
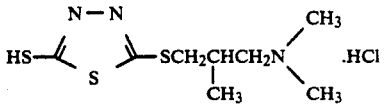
(9)
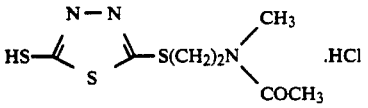
(10)
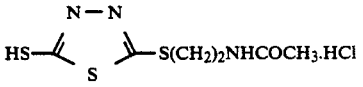
(11)
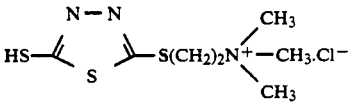
(12)
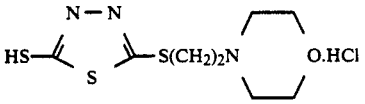
(13)
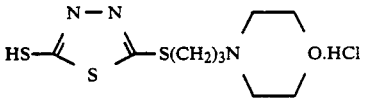
(14)
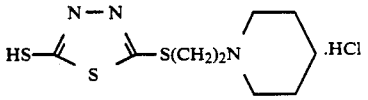
(15)
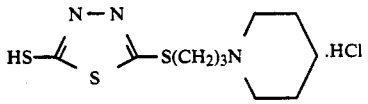
(16)
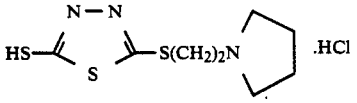
(17)
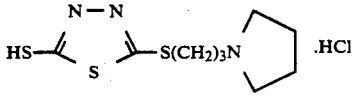
(18)
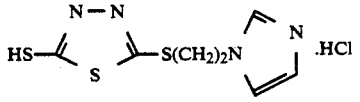
(19)
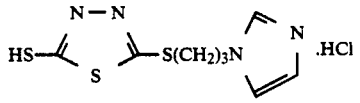
-continued
(20)
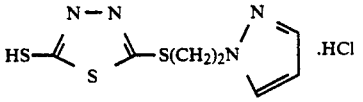
(21)
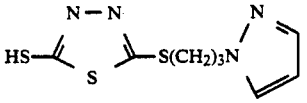
(22)
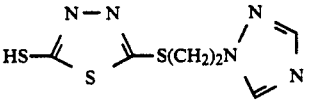
(23)
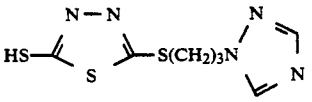
(24)
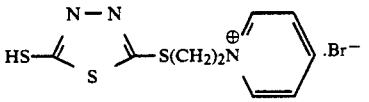
(25)
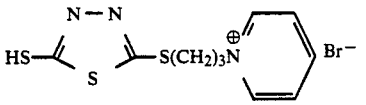
(26)
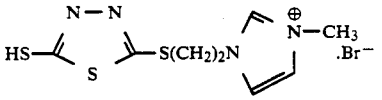
(27)
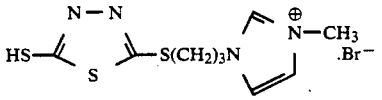
(28)
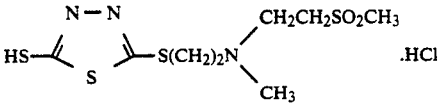
(29)
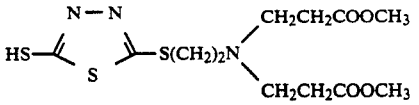
(30)
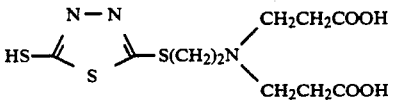
(31)
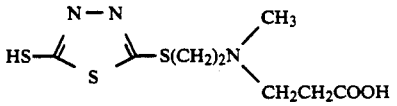
(32)
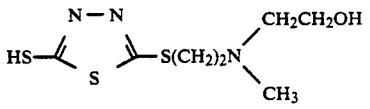

-continued (33)

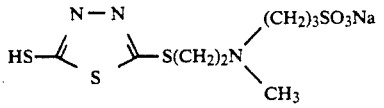

(34)

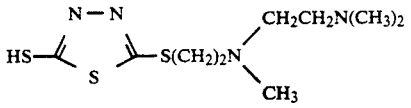

(35)

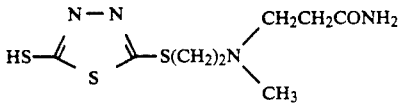

(36)

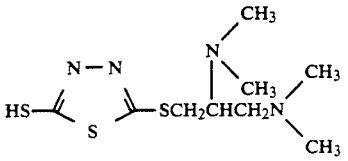

(37)

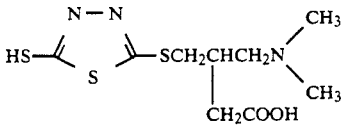

(38)

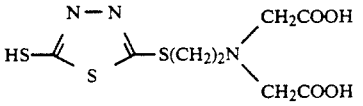

(39)

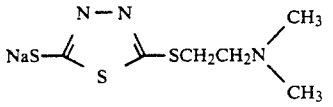

(40)

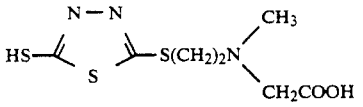

The compounds represented by the general formula (IV) can be readily synthesized by alkylation of 2,5-dimercapto-1,3,4-thiadiazole, making reference to *Advanced in Heterocyclic Chemistry*, Vol. 9, pages 165 to 209 (1968). Specific examples of such synthesis are described in JP-A-61-20945.

The compound represented by the general formula (IV) for use in the present invention as the bleaching accelerator may be added to the bleach-fixing bath and/or to the pre-bath thereof. The amount of the compound to be added according to the present invention depends on the type of the processing solution and the photographic material to be processed, the processing temperature, and the targetted time for the processing, but optional amount is in the range of from $1\times10^{-5}$ to 1 mol, more preferably, from $1\times10^{-4}$ to $1\times10^{-1}$ mol per 1 l of the processing solution. These bleach accelerating agents are particularly effectively employed when color photographic light sensitive materials for photographing are subjected to bleach-fix processing.

Examples of the fixing agents which can be employed in the fixing solution or bleach-fixing solution include thiosulfates, thiocyanate, thioether compounds, thioureas, or a large amount of iodide are exemplified. Of these compounds, thiosulfates are generally employed. Particularly, ammonium thiosulfate is most widely employed. It is preferred to use sulfites, bisulfites or carbonylbisulfite adducts as preservatives in the bleach-fixing solution.

After a desilvering step, the silver halide color photographic material according to the present invention is generally subjected to a water washing step and/or a stabilizing step.

The amount of water required for the water washing step may be set in a wide range depending on characteristics of photographic light-sensitive materials (due to elements used therein, for example, couplers, etc.), uses thereof, temperature of the washing water, the number of water washing tanks (stages), a replenishment system such as countercurrent or concurrent, or other various conditions. The relationship between the number of water washing tanks and the amount of water in a multi-stage countercurrent system can be determined based on the method as described in *Journal of the Society of Motion Picture and Television Engineers*, Vol. 64, pp. 248–253 (May, 1955).

According to the multi-stage countercurrent system described in the above article, the amount of water for washing can be significantly reduced. However, an increase in staying time of water in a tank causes propagation of bacteria and problems occur such as adhesion of floatage formed on the photographic materials. In the method of processing the silver halide color photographic material according to the present invention, a method for reducing amounts of calcium ions and magnesium ions as described in JP-A-62-288838 can be particularly effectively employed in order to solve such problems. Further, sterilizers, for example, isothiazolone compounds as described in JP-A-57-8542, thiabendazoles, chlorine type sterilizers such as sodium chloroisocyanurate, benzotriazoles, sterilizers as described in Hiroshi Horiguchi, *Bokin-Bobai No Kagaku, Biseibutsu No Mekkin-, Sakkin-, Bobai-Gijutsu*, edited by Eiseigijutsu Kai, and *Bokin-Bobaizai Jiten*, edited by Nippon Bokin-Bobai Gakkai can be employed.

The pH of the washing water used in the processing of the photographic light-sensitive materials according to the present invention is usually from 4 to 9, preferably from 5 to 8. The temperature of the washing water and the time for a water washing step can be variously set depending on characteristics or uses of photographic light-sensitive materials. However, it is customary to select a range of from 15° C. to 45° C. and a period from 20 sec. to 10 min. and preferably a range of from 25° C. to 40° C. and a period of from 30 sec. to 5 min.

The photographic light-sensitive material of the present invention can also be directly processed with a stabilizing solution in place of the above-described water washing step. In such a stabilizing process, any of known methods described, for example, in JP-A-57-8543, JP-A-58-14834 and JP-A-60-220345, can be employed.

Further, it is possible to conduct the stabilizing process subsequent to the above-described water washing process. One example thereof is a stabilizing bath containing formaldehyde and a surface active agent, which is employed as a final bath in the processing of color photographic light-sensitive materials for photographing. To such a stabilizing bath, various chelating agents and antimolds may also be added.

Overflow solutions resulting from replenishment for the above-described washing water and/or stabilizing solution may be reused in other steps such as the desilvering step.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of developing agents include: indoaniline type compounds described in U.S. Pat. No. 3,342,597; Schiff's base type compounds as described in U.S. Pat. No. 3,342,599 and *Research Disclosure*, No. 14850 and ibid., No. 15159; aldol compounds described in *Research Disclosure*, No. 13924; metal salt complexes described in U.S. Pat. No. 3,719,492; and urethane type compounds described in JP-A-53-135628.

Further, the silver halide color photographic material according to the present invention may contain, if desired, various 1-phenyl-3-pyrazolidones for the purpose of accelerating color development. Typical examples of these compounds include those described, for example, in JP-A-56-64339, JP-A-57-144547, and JP-A-58-115438.

In the present invention, various kinds of processing solutions can be employed in a temperature range from 10° C. to 50° C. Although a standard temperature is from 33° C. to 38° C., it is possible to carry out the processing at higher temperatures in order to accelerate the processing whereby the processing time is shortened, or at lower tempetatures in order to improve image quality and to maintain stability of the processing solutions.

Further, for the purpose of saving the amount of silver employed in the color photographic light-sensitive material, the photographic processing may be conducted utilizing color intensification using cobalt or hydrogen peroxide described in West German Patent 2,226,770 or U.S. Pat. No. 3,674,499.

Moreover, the silver halide color photographic material of the present invention can be applied to heat-developable light-sensitive materials described, for example, in U.S. Pat. No. 4,500,626, JP-A-60-133449, JP-A-59-218443, JP-A-61-238056 and European Patent 210,660A2.

The present invention is explained in greater detail with reference to the following examples, but the present invention should not be construed as being limited thereto.

EXAMPLE 1

First, 20 g of inert gelatin, 2.4 g of potassium bromide and 2.05 g of potassium iodide were dissolved in 800 ml of distilled water, and the aqueous solution was maintained at 58° C. by stirring. To the solution were added in an instant 150 ml of an aqueous solution containing 5.0 g of silver nitrate dissolved and then an excess amount of potassium bromide, and the mixture was subjected to physical ripening for 20 minutes. Then, 0.2 mol/liter, 0.67 mol/liter and 2 mol/liter of aqueous solution of silver nitrate and aqueous solution of potassium halide (mixture of potassium bromide and potassium iodide in a ratio of 58 mol% and 42 mol%) were added thereto at a rate of 10 ml per minute respectively to allow growth of silver iodobromide grains having an iodide content of 42 mol% according to the method described in U.S. Pat. No. 4,242,445. The emulsion was washed with water for desalting to prepare Emulsion a. The yield of Emulsion a was 900 g. An average grain size of Emulsion a was 0.69 μm.

To 200 g of Emulsion a were added 850 ml of distilled water and 30 ml of a 10% aqueous solution of potassium bromide, the mixture was maintained at 70° C. by stirring. To the mixture were added simultaneously 300 ml of an aqueous solution containing 33 g of silver nitrate dissolved and 320 ml of an aqueous solution containing 25 g of potassium bromide dissolved over a period of 30 minutes. Then, were added simultaneously 800 ml of an aqueous solution containing 100 g of silver nitrate dissolved and 860 ml of an aqueous solution containing 75 g of potassium bromide dissolved over a period of 60 minutes to prepare a silver iodobromide emulsion having a silver iodide content of 10 mol% and an average grain size of 1.09 μm which was designated Emulsion D. Emulsion D contained twin crystals having an aspect ratio of 2.3 and a face ratio of (111) face of 85%. In a similar manner to the above, Emulsions A to G as described in Table 1 below were prepared.

Sample 101

On a cellulose triacetate film support prepared by the method for production described in JP-A-62-115035 was coated each layer having the composition set forth below to prepare a multilayer color photographic light-sensitive material which was designated Sample 101.

With respect to the compositions of the layers, the coating amounts are shown in units of g/m$^2$, coating amounts of silver halide are shown in terms of silver coating amount in units of g/m$^2$, and those of sensitizing dyes are shown as a molar amount per mole of silver halide present in the same layer.

| | |
|---|---|
| First Layer: Antihalation Layer | |
| Black colloidal silver | 0.18 (as silver) |
| Gelatin | 1.40 |
| Second Layer: Intermediate Layer | |
| 2,5-Di-tert-pentadecylhydroquinone | 0.18 |
| EX-1 | 0.20 |
| EX-3 | 0.09 |
| U-1 | 0.06 |
| U-2 | 0.08 |
| U-3 | 0.10 |
| HBS-1 | 0.10 |
| HBS-2 | 0.02 |
| Gelatin | 1.04 |
| Third Layer: First Red-Sensitive Emulsion Layer | |
| Emulsion A | 0.20 (as silver) |
| Emulsion B | 0.20 (as silver) |
| Sensitizing Dye IX | $6.9 \times 10^{-5}$ |
| Sensitizing Dye II | $1.8 \times 10^{-5}$ |
| Sensitizing Dye III | $3.1 \times 10^{-4}$ |
| EX-2 | 0.335 |
| EX-3 | 0.025 |
| EX-10 | 0.020 |
| EX-15 | 0.015 |
| Gelatin | 0.87 |
| Fourth Layer: Second Red-sensitive Emulsion Layer | |
| Emulsion C | 1.00 (as silver) |
| Sensitizing Dye IX | $5.1 \times 10^{-5}$ |
| Sensitizing Dye II | $1.4 \times 10^{-5}$ |
| Sensitizing Dye III | $2.3 \times 10^{-4}$ |
| EX-2 | 0.400 |
| EX-3 | 0.025 |
| EX-14 | 0.030 |
| EX-10 | 0.015 |
| Gelatin | 1.30 |
| Fifth Layer: Third Red-Sensitive Emulsion Layer | |
| Emulsion D | 1.40 |

-continued

| | |
|---|---|
| | (as silver) |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| EX-3 | 0.007 |
| EX-4 | 0.080 |
| EX-2 | 0.095 |
| HBS-1 | 0.22 |
| HBS-2 | 0.10 |
| Gelatin | 1.63 |
| Sixth Layer: Intermediate Layer | |
| EX-5 | 0.060 |
| HBS-1 | 0.040 |
| Gelatin | 0.70 |
| Seventh Layer: | |
| First Green-Sensitive Emulsion Layer | |
| Emulsion A | 0.15 |
| | (as silver) |
| Emulsion B | 0.15 |
| | (as silver) |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.012 |
| EX-7 | 0.015 |
| EX-8 | 0.025 |
| EX-15 | 0.020 |
| HBS-1 | 0.100 |
| HBS-3 | 0.010 |
| Gelatin | 0.63 |
| Eighth Layer: | |
| Second Green-Sensitive Emulsion Layer | |
| Emulsion C | 1.00 |
| | (as silver) |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.094 |
| EX-8 | 0.018 |
| EX-7 | 0.026 |
| HBS-1 | 0.160 |
| HBS-3 | 0.008 |
| Gelatin | 0.50 |
| Ninth Layer: Third Green-Sensitive Emulsion Layer | |
| Emulsion D | 1.20 |
| | (as silver) |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-13 | 0.015 |
| EX-11 | 0.100 |
| EX-1 | 0.025 |
| HBS-1 | 0.25 |
| HBS-2 | 0.10 |
| Gelatin | 1.54 |
| Tenth Layer: Yellow Filter Layer | |
| Yellow colloidal silver | 0.05 |
| | (as silver) |
| EX-5 | 0.08 |
| HBS-1 | 0.03 |
| Gelatin | 0.95 |
| Eleventh Layer: | |

-continued

| | |
|---|---|
| First Blue-Sensitive Emulsion Layer | |
| Emulsion A | 0.08 |
| | (as silver) |
| Emulsion B | 0.07 |
| | (as silver) |
| Emulsion C | 0.15 |
| | (as silver) |
| Sensitizing Dye VIII | $3.5 \times 10^{-4}$ |
| EX-9 | 0.721 |
| EX-8 | 0.042 |
| HBS-1 | 0.28 |
| Gelatin | 1.10 |
| Twelfth Layer: | |
| Second Blue-sensitive Emulsion Layer | |
| Emulsion C | 0.70 |
| | (as silver) |
| Sensitizing Dye VIII | $2.1 \times 10^{-4}$ |
| EX-9 | 0.154 |
| EX-10 | 0.007 |
| HBS-1 | 0.05 |
| Gelatin | 0.78 |
| Thirteenth Layer: | |
| Third Blue-Sensitive Emulsion Layer | |
| Emulsion D | 0.80 |
| | (as silver) |
| Sensitizing Dye VIII | $2.2 \times 10^{-4}$ |
| EX-9 | 0.20 |
| HBS-1 | 0.07 |
| Gelatin | 0.69 |
| Fourteenth Layer: First Protective Layer | |
| U-4 | 0.11 |
| U-5 | 0.17 |
| HBS-1 | 0.05 |
| Gelatin | 1.00 |
| Fifteenth Layer: Second Protective Layer | |
| Polymethyl acrylate particle (diameter: about 1.5 μm) | 0.54 |
| Emulsion G | 0.10 |
| H-1 | 0.380 |
| S-1 | 0.20 |
| S-2 | 0.05 |
| Gelatin | 1.20 |

4-Chloro-3,5-dimethylphenol and a surface active agent were added to each of the layers in addition to the above described components.

Samples 102 to 104

Samples 102 to 104 were prepared in the same manner as described for Sample 101, except for substituting the emulsions described in Table 2 below for the emulsions used in Sample 101, respectively.

Samples 105 to 108

Samples 105 to 108 were prepared in the same manner as described for Sample 101, except for adding each $2 \times 10^{-6}$ mol per $m^2$ of Compound (17) according to the present invention to the fifth layer, ninth layer and thirteenth layer of Samples 101 to 104, respectively.

TABLE 1

| Emulsion | Average AgI Content (%) | Average Grain Diameter (μm) | Coefficient of Variation of Grain Diameter (%) | Aspect Ratio | Core/Shell Ratio in Prescription | AgI Content In Prescription Core (%) | AgI Content In Prescription Shell (%) |
|---|---|---|---|---|---|---|---|
| A | 4.0 | 0.30 | 17 | 1.0 | 1/2 | 12.0 | 0 |
| B | 8.0 | 0.55 | 15 | 1.2 | 1/2 | 24.0 | 0 |
| C | 10.0 | 0.74 | 21 | 2.1 | 24/76 | 42.0 | 0 |
| D | 10.0 | 1.09 | 25 | 2.3 | 24/76 | 42.0 | 0 |
| E | 16.0 | 1.12 | 29 | 2.6 | 38/62 | 42.0 | 0 |
| F | 14.0 | 0.76 | 27 | 2.4 | 1/2 | 42.0 | 0 |
| G | 1.0 | 0.08 | 13 | 1.0 | (uniform) | — | — |

TABLE 2

| Layer | Sample 101, 105[1)] Emulsion | Silver Coating Amount ($g/m^2$) | Sample 102, 106 Emulsion | Silver Coating Amount ($g/m^2$) | Sample 103, 107 Emulsion | Silver Coating Amount ($g/m^2$) | Sample 104, 108 Emulsion | Silver Coating Amount ($g/m^2$) |
|---|---|---|---|---|---|---|---|---|
| 4th | C | 1.00 | C | 1.00 | C | 0.50 | C | 0.50 |
| | | | | | F | 0.50 | F | 0.50 |
| 5th | D | 1.40 | D | 0.47 | D | 0.47 | E | 1.40 |
| | | | E | 0.93 | E | 0.93 | | |
| 8th | C | 1.00 | C | 1.00 | C | 0.50 | C | 0.50 |
| | | | | | F | 0.50 | F | 0.50 |
| 9th | D | 1.20 | D | 0.80 | D | 0.40 | E | 1.20 |
| | | | E | 0.40 | E | 0.80 | | |
| 12th | C | 0.70 | C | 0.70 | C | 0.35 | C | 0.35 |
| | | | | | F | 0.35 | F | 0.35 |
| 13th | D | 0.80 | D | 0.27 | D | 0.27 | E | 0.80 |
| | | | E | 0.53 | E | 0.53 | | |
| Average Silver Iodide Content in All Emulsion Layers | | 9.3 | | 10.9 | | 12.0 | | 13.0 |

1): The silver iodide content as described in JP-A-60-128443.

These color photographic light-sensitive materials were exposed for sensitometry and subjected to the color development processing described below.

Further, these samples were uniformly irradiated with X-ray (120 KV, 2 seconds) and subjected to the same color development processing.

The results of photographic performance thus obtained and RMS value (measured by an aperture having a diameter of 48 μm), which indicates graininess are shown in Table 3 below.

Moreover, degree of poor desilveration in case of changing the time for fixing step to 1 min. 30 sec. in the development processing described below was evaluated by a density at the area having a cyan density of 2.0 obtained by fixing time of 6 min. 30 sec.

The development processing was conducted at 38° C. with the following processing steps.

| Processing Step | Time |
|---|---|
| 1 Color Development | 3 min. 15 sec. |
| 2 Bleaching | 6 min. 30 sec. |
| 3 Washing with Water | 3 min. 15 sec. |
| 4 Fixing | 6 min. 30 sec. |
| 5 Washing with Water | 3 min. 15 sec. |
| 6 Stabilizing | 3 min. 15 sec. |

The composition of the processing solution used in each step is illustrated below.

| | |
|---|---|
| Color Developing Solution: | |
| Sodium nitrilotriacetate | 1.0 g |
| Sodium sulfite | 4.0 g |
| Sodium carbonate | 30.0 g |
| Potassium bromide | 1.4 g |
| Hydroxylamine Sulfate | 2.4 g |
| 4-(N-Ethyl-N-β-hydroxyethylamino)-2-methylaniline sulfate | 4.5 g |
| Water to make | 1 liter |
| Bleaching Solution: | |
| Ammonium bromide | 160.0 g |
| Aqueous ammonia (28%) | 25.0 ml |
| Sodium ethylenediaminetetraacetate | 130 g |
| Glacial acetic acid | 14 ml |
| Water to make | 1 liter |
| Fixing Solution: | |
| Sodium tetrapolyphosphate | 2.0 g |
| Sodium sulfite | 4.0 g |
| Ammonium thiosulfate (70% aqueous solution) | 175.0 ml |
| Sodium bisulfite | 4.6 g |
| Water to make | 1 liter |
| Stabilizing Solution: | |
| Formalin | 8.0 ml |
| Water to make | 1 liter |

TABLE 3

| Sample | ΔFog[1)] $D_R$ | $D_G$ | $D_B$ | RMS × 1,000[2)] No Irradiation with X-ray R | G | B | Irradiation with X-ray R | G | B | Relative Sensitivity[3)] No Irradiation with X-ray R | G | B | Irradiation with X-ray R | G | B | Desilvering[4)] Property |
|---|---|---|---|---|---|---|---|---|---|---|---|---|---|---|---|---|
| 101 (Comparison) | 0.17 | 0.13 | 0.08 | 11.0 | 10.5 | 25.6 | 12.3 | 12.0 | 26.2 | 0.00 | 0.00 | 0.00 | −0.15 | −0.12 | −0.07 | 2.22 |
| 102 (Comparison) | 0.14 | 0.10 | 0.07 | 10.6 | 10.3 | 25.4 | 11.6 | 11.2 | 25.9 | +0.01 | −0.00 | +0.02 | −0.11 | −0.09 | −0.03 | 2.20 |
| 103 (Comparison) | 0.13 | 0.09 | 0.06 | 10.5 | 10.2 | 25.3 | 11.3 | 10.9 | 25.7 | 0.00 | −0.01 | +0.03 | −0.10 | −0.08 | −0.02 | 2.19 |
| 104 (Comparison) | 0.12 | 0.09 | 0.06 | 10.4 | 10.2 | 25.3 | 11.2 | 10.9 | 25.6 | −0.01 | −0.01 | +0.02 | −0.10 | −0.08 | −0.02 | 2.20 |
| 105 (Comparison) | 0.16 | 0.12 | 0.08 | 10.8 | 10.5 | 25.4 | 12.2 | 12.0 | 26.2 | 0.00 | −0.01 | −0.01 | −0.14 | −0.12 | −0.07 | 2.12 |
| 106 (Present Invention) | 0.12 | 0.08 | 0.06 | 10.4 | 10.1 | 25.2 | 11.4 | 10.9 | 25.7 | +0.01 | −0.01 | +0.01 | −0.09 | −0.08 | −0.02 | 2.08 |
| 107 (Present Invention) | 0.11 | 0.08 | 0.06 | 10.4 | 10.0 | 25.2 | 11.1 | 10.7 | 25.6 | 0.00 | −0.02 | +0.03 | −0.09 | −0.07 | −0.01 | 2.08 |
| 108 (Present | 0.11 | 0.08 | 0.06 | 10.3 | 10.1 | 25.2 | 11.1 | 10.7 | 25.5 | −0.01 | −0.01 | +0.01 | −0.09 | −0.07 | −0.01 | 2.09 |

TABLE 3-continued

| | | | | RMS × 1,000[2] | | | | | | Relative Sensitivity[3] | | | | | | |
|---|---|---|---|---|---|---|---|---|---|---|---|---|---|---|---|---|
| | ΔFog[1] | | | No Irradiation with X-ray | | | Irradiation with X-ray | | | No Irradiation with X-ray | | | Irradiation with X-ray | | | Desilvering[4] |
| Sample | $D_R$ | $D_G$ | $D_B$ | R | G | B | R | G | B | R | G | B | R | G | B | Property |
| Invention) | | | | | | | | | | | | | | | | |

1) Increasing amount of the minimum color density of cyan ($D_R$), magenta ($D_G$) and Yellow ($D_B$) with X-ray irradiation.
2) 1,000 times of RMS value in an exposure amount necessary for obtaining density of fog +0.2 in Sample 101 without X-ray irradiation.
3) Relative value taking a reciprocal of an exposure amount necessary for obtaining density of fog +0.2 in Sample 101 as O.
4) Cyan density obtained by fixing for 1 min. 30 sec. at the area exposed to light in an amount necessary for obtaining a cyan density of 2.0 obtained by to X-ray irradiation. The higher the value is, the worse the desilvering property is.

From the results shown in Table 3, it can be seen that the samples according to the present invention are excellent in graininess and desilvering property in case of no-irradiation with X-ray, and exhibit remarkably small values with respect to increase in fog, decrease in sensitivity and deterioration of graininess when they are irradiated with X-ray.

EXAMPLE 2

Samples prepared by using an equimolar amount of Compound (18), 0.4 time moles of Compound (11), 0.4 time moles of Compound (12), and a mixture of 0.5 time moles of Compound (17) and 0.2 time moles of Compound (11), in place of Compound (17) according to the present invention added to the fifth layer, the ninth layer and the thirteenth layer of Sample 107 respectively, exhibited almost same results with respect to relative sensitivity, fog, graininess and desilvering property before and after X-ray irradiation. These properties are apparently superior to those obtained from Sample 103 which does not contain the compound according to the present invention.

The structural formulae of the compounds employed in Examples 1 and 2 are illustrated hereinafter.

EX-1

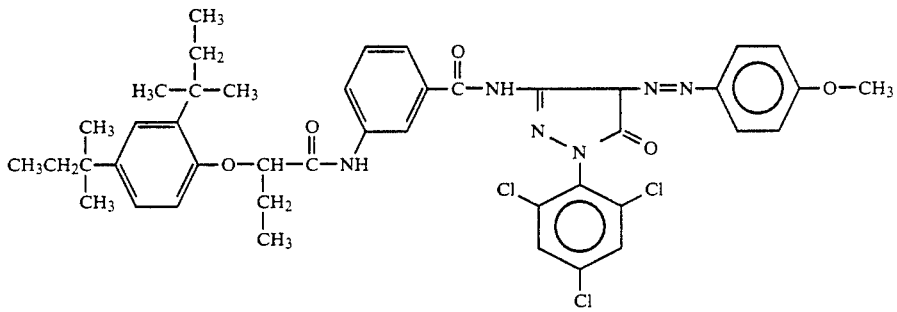

EX-2

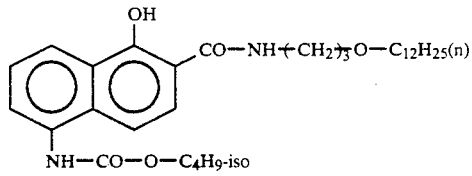

EX-3

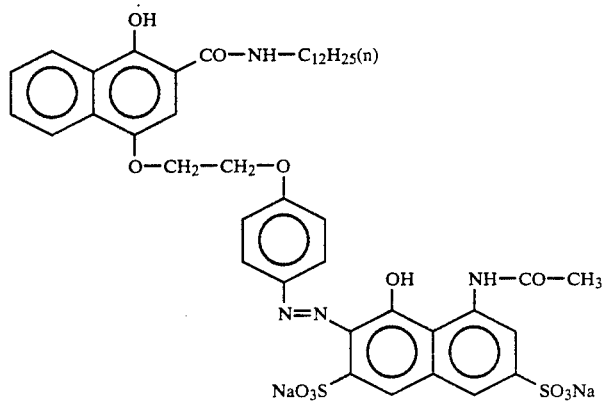

-continued
EX-4
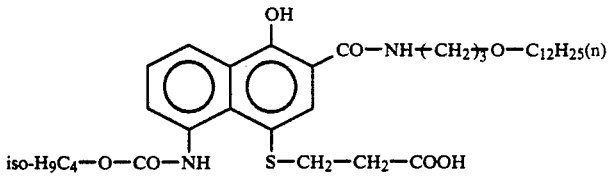
EX-5
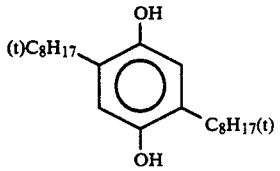
EX-6
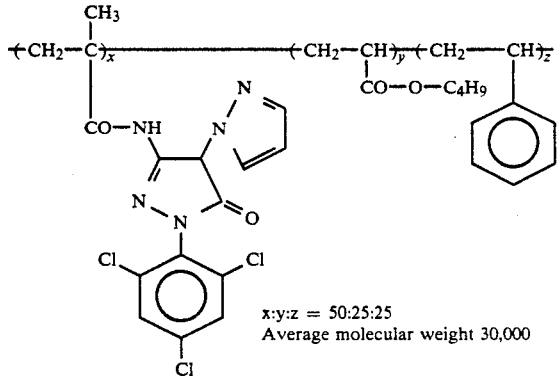
EX-7
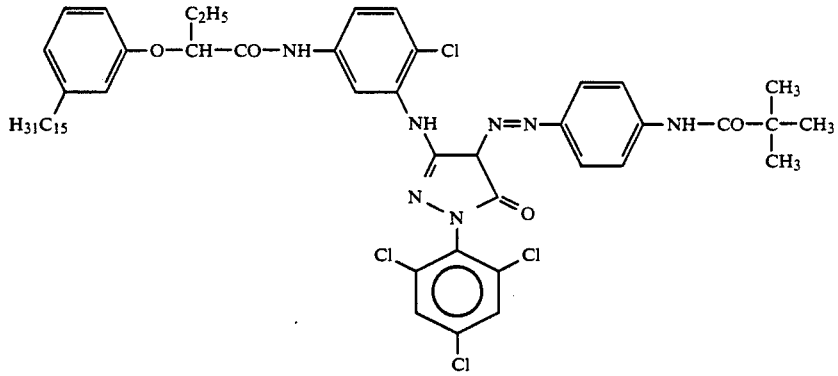
EX-8
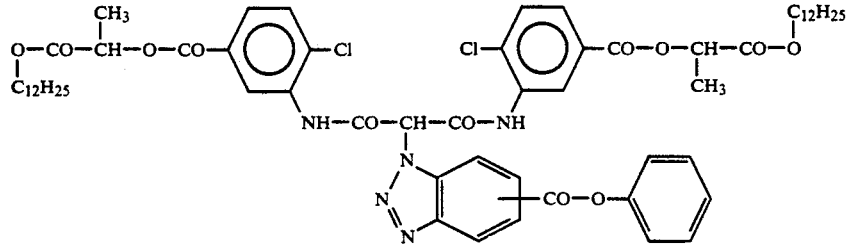

-continued
EX-9
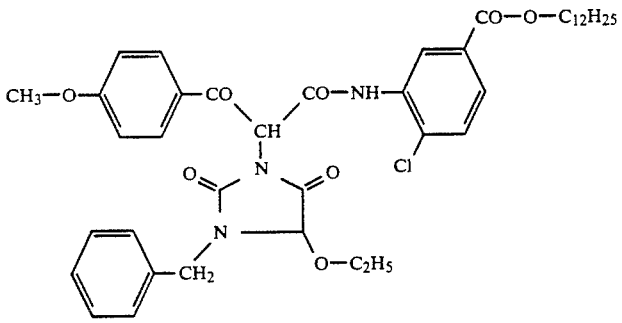
EX-10
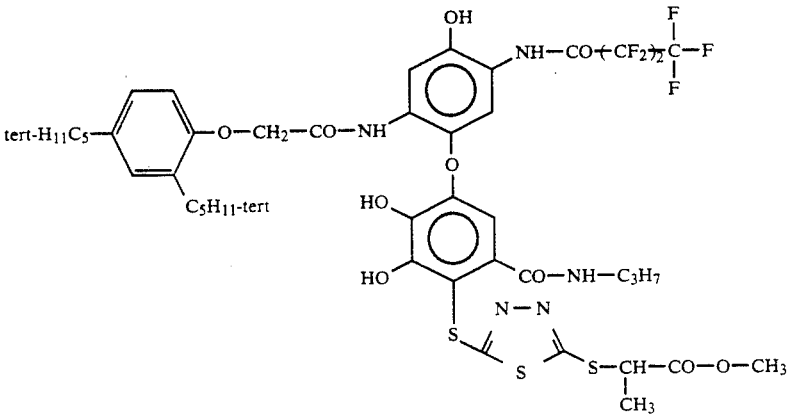
EX-11
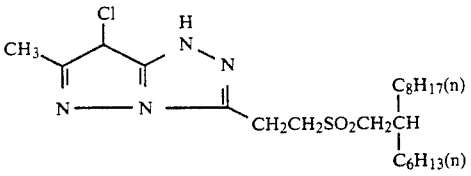
EX-13
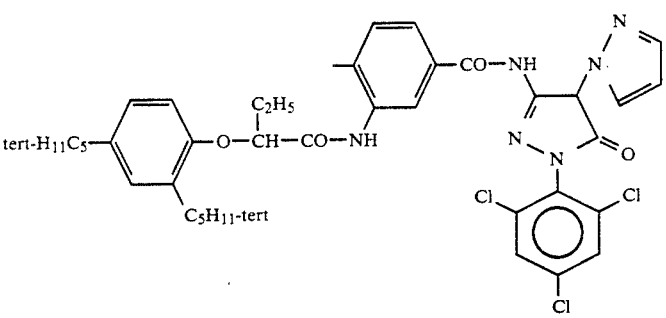
EX-14
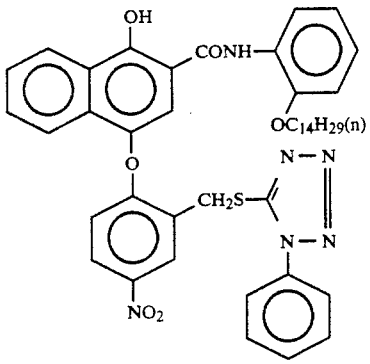

-continued
EX-15
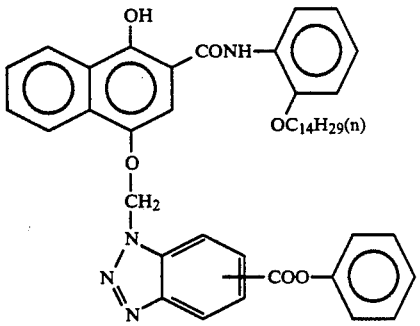
U-1
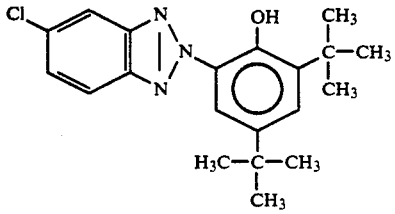
U-2
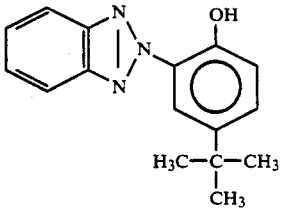
U-3
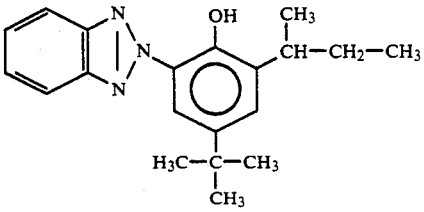
U-4
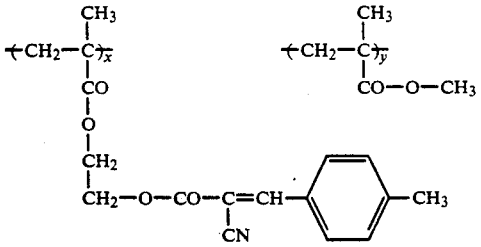
x/y = 7/3, aberage molecular weight 30,000
U-5
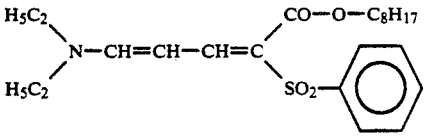
Tricresyl phosphate HBS-1
Dibutyl phthalate HBS-2

-continued
HBS-3
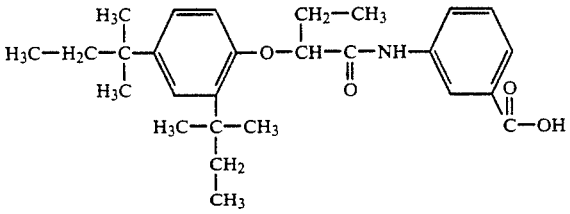
Sensitizing dye II
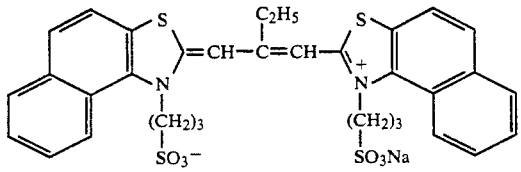
Sensitizing dye III
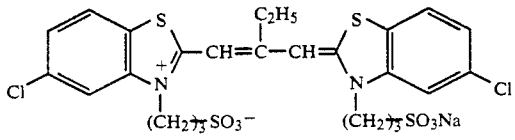
Sensitizing Dye V
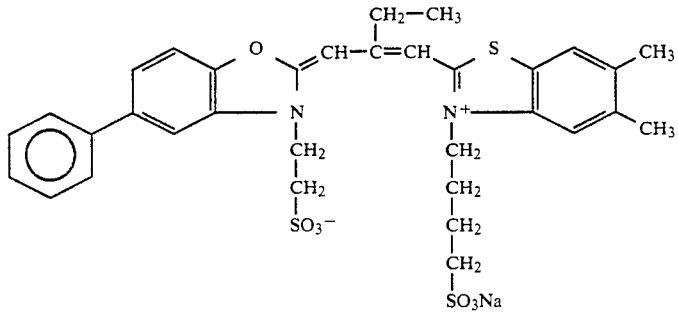
Sensitizing dye VI
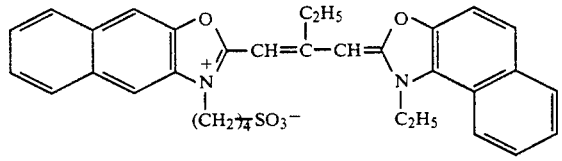
Sensitizing dye VII
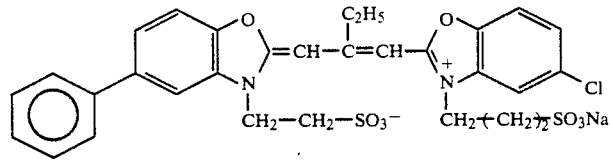
Sensitizing dye VIII
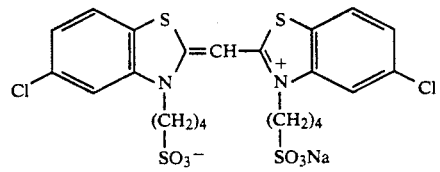
Sensitizing dye IX
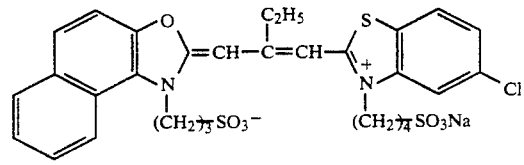

-continued

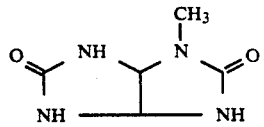

S-1

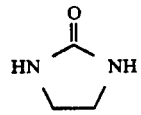

S-2

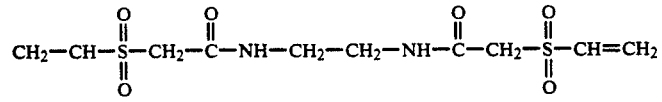

H-1

EXAMPLE 3

The color photographic light-sensitive material prepared in Example 1 was cut into 35-mm width, and was exposed to light through a wedge so that the exposure amount at the maximum density area be 5 CMS. Thus exposed photographic light-sensitive material was then subjected to processing comprising steps given below together with the processing bathes. Evaluation of the photographic performances was made on samples subjected in advance to imagewise exposure to light at the standard ISO 400 light-exposure condition. Thus light-exposed samples were each subjected to continuous (running) processing until the accumulated amount of the replenisher became twice as large as the tank capacity.

TABLE 4

| Processing Step | Processing Condition: Processing Time | Processing Temperature | Amount of*1 Replenishment | Capacity of Tank |
|---|---|---|---|---|
| Color Development | 3 min. 15 sec. | 38° C. | 45 ml | 5 l |
| Bleach-fixing | 4 min. | 38° C. | 50 ml | 5 l |
| Washing (1) | 20 sec. | 35° C. | * | 2 l |
| Washing (2) | 20 sec. | 35° C. | 30 ml | 2 l |
| Stabilization | 25 sec. | 35° C. | 20 ml | 2 l |
| Drying | 50 sec. | 65° C. | | |

*Two tank countercurrent system, flowing from (2) to (1)
*1Amount of replenishment per meter of 35 mm width strip The composition for each processing solution is given below

| Color Developing Solution: | Tank Solution (g) | Relenisher (g) |
|---|---|---|
| Diethylenetriaminepentaacetic acid | 2.0 | 2.2 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-(N-Ethyl-N-β-hydroxyethylamino)-2-methylaniline sulfate | 4.5 | 5.5 |
| Water to make | 1.0 l | 1.0 l |
| pH | 10.05 | 10.10 |

-continued

| Bleach-fixing Solution: (for both tank solution and replenisher) | (g) |
|---|---|
| Ammonium ethylenediaminetetraacetato ferrate.dihydrate | 90.0 |
| Disodium ethylenediaminetetraacetate | 5.0 |
| Sodium sulfite | 12.0 |
| Aqueous solution of ammonium thiosulfate (70%) | 300.0 ml |
| Acetic acid (98%) | 5.0 ml |
| Water to make | 1.0 l |
| pH | 6.0 |
| **Stabilization solution: (for both tank solution and replenisher)** | |
| Formaldehyde (37%) | 2.0 ml |
| Polyoxyethylene-p-monononylphenyl ether (av. polymerization degree: 10) | 0.30 |
| Disodium ethylenediaminetetraacetate | 0.05 |
| Water to make | 1.0 l |
| pH | 5.0–8.0 |
| **Washing Water: (for both tank solution and replenisher)** | |

Municipal water was passed through a mixed-bed type column charged with an H type strongly acidic cation-exchange resin (Amberlite ® IR-120B; a product of Rohm & Haas Co.) and an OH type anion exchange resin (Amberlite ® IR-400; a product of Rohm & Haas Co.), so as to control the ion concentration of calcium and magnesium ion to 3 mg/l or lower. To the treated water were further added 20 mg/l of sodium isocyanuric acid dichloride and 0.15 g/l of sodium sulfate. The pH of thus prepared solution fell in the range of from 6.5 to 7.5.

Desilvering property of each sample is evaluated on finishing the running processing, by comparing the amount of residual silver at the highest density area. Table 5 gives the results. The amount of residual silver was obtained by X-ray fluorescence analysis. Smaller value indicates better desilvering property.

TABLE 5

| Sample No. | Residual silver ($\mu g/cm^2$) | Note |
|---|---|---|
| 101 | 24.2 | Comparison |
| 102 | 7.7 | " |
| 103 | 6.6 | " |
| 104 | 7.0 | " |
| 105 | 20.1 | " |
| 106 | 3.3 | Present Invention |
| 107 | 3.2 | Present Invention |
| 108 | 4.7 | Present |

TABLE 5-continued

| Sample No. | Residual silver ($\mu g/cm^2$) | Note |
|---|---|---|
| | | Invention |

As is obvious from Table 5, samples comprising silver halide grains according to the present invention shows an extremely improved desilvering property to give favorable results.

EXAMPLE 4

The color photographic light-sensitive material prepared in Example 1 was subjected to the same processing as described in Example 3, and the desilvering property was similarly evaluated. Table 7 gives the results.

TABLE 6

| Processing Step | Processing Time | Processing Temperature | Amount of*1 Replenishment | Capacity of Tank |
|---|---|---|---|---|
| | Processing Condition | | | |
| Color Development | 3 min. 15 sec. | 38° C. | 45 ml | 10 l |
| Bleaching | 1 min. | " | 20 ml | 4 l |
| Bleach-fixing | 3 min. 15 sec. | " | 30 ml | 8 l |
| Washing (1) | 40 sec. | 35° C. | * | 4 l |
| Washing (2) | 1 min. | " | 30 ml | 4 l |
| Stabilization | 40 sec. | 38° C. | 20 ml | 4 l |
| Drying | 1 min. 15 sec. | 55° C. | — | — |

*Two-tank countercurrent system, flowing from (2) to (1)
*1Amount of replenishment per meter of 35 mm width strip The composition for each processing solution is given below.

Color Developing Solution:

The same as that used in Example 3.

| Bleaching solution: | (g) |
|---|---|
| (for both tank solution and replenisher) | |
| Ammonium ethylenediaminetetraacetato ferrate.dihydrate | 120.0 |
| Disodium ethylenediaminetetraacetate | 10.0 |
| Ammonium bromide | 100.0 |
| Ammonium nitrate | 10.0 |
| Bleaching accelerator | $5 \times 10^{-3}$ mol |

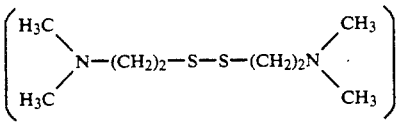

| | |
|---|---|
| Ammonium water (27%) | 15.0 ml |
| Water to make | 1.0 l |
| pH | 6.3 |

| Bleach-fixing solution: | (g) |
|---|---|
| (for both tank soluton and replenisher) | |
| Ammonium ethylenediaminetetraacetato ferrate.dihydrate | 50.0 |
| Disodium ethylenediaminetetraacetate | 5.0 |
| Sodium sulfite | 12.0 |
| Aqueous solution of ammonium thiosulfate | 240.0 ml |
| Ammonia water (27%) | 6.0 ml |
| Water to make | 1.0 l |
| pH | 7.2 |

Washing solution:

The same as that used in Example 3.

-continued

Stabilization solution:

The same as that used in Example 3.

TABLE 7

| Sample No. | Residual silver ($\mu g/cm^2$) | Note |
|---|---|---|
| 101 | 18.4 | Comparison |
| 102 | 4.7 | " |
| 103 | 3.2 | " |
| 104 | 3.9 | " |
| 105 | 15.2 | " |
| 106 | 1.5 | Present Invention |
| 107 | 1.5 | Present Invention |
| 108 | 1.9 | Present Invention |

As is obvious from the results shown above, samples containing silver halide grains according to the present invention exhibit excellent desilvering properties also in a processing comprising bleaching—bleach-fixing step as the desilvering step.

EXAMPLE 5

The color photographic light-sensitive material prepared in Example 1 (Sample 101) was cut into 35-mm width, and was image-wise exposed to light under a standard light-exposure condition of ISO 400. Then, the light-exposed material was subjected to continuous processing (running processing) by means of an automatic developing machine. In the running processing, 50 meters per day of sample 101 of 35 mm width was continuously processed for 20 days.

The cross-over time for each processing solution in the automatic processor was 5 seconds each.

Further in the bleaching solution tank of the automatic developing machine was installed an aerator, from which air in fine bubbles was supplied to the processing solution for 10 hours a day.

The processing was performed in steps as follows.

| Processing Step | Processing Time | Processing Temperature | Amount of*1 Replenishment | Capacity of Tank |
|---|---|---|---|---|
| Color Development | 3 min. 15 sec. | 38° C. | 38 ml | 10 l |
| Bleaching | 40 sec. | " | 4 ml | 5 l |
| Fixing | 1 min. | " | 30 ml | 5 l |
| Stabilization (1) | 20 sec. | " | — | 3 l |
| Stabilization (2) | 20 sec. | " | — | 3 l |
| Stabilization (3) | 20 sec. | " | 35 ml* | 3 l |
| Drying | 1 min. 15 sec. | 50–70° C. | | |

*Three tank countercurrent system, flowing from (3) via (2) to (1)
*1Amount of replenishment per meter of 35 mm width strip The composition for each processing solution is given below.

| | Tank Solution (g) | Replenisher (g) |
|---|---|---|
| Color Developing Solution: | | |

-continued

| | | |
|---|---|---|
| Diethylenetriaminepentaacetic acid | 5.0 | 6.0 |
| Sodium sulfite | 4.0 | 4.4 |
| Potassium carbonate | 30.0 | 37.0 |
| Potassium bromide | 1.3 | 0.9 |
| Potassium iodide | 1.2 mg | — |
| Hydroxylamine sulfate | 2.0 | 2.8 |
| 4-(N-Ethyl-N-β-hydroxyethyl-amino)-2-methylaniline sulfate | 4.7 | 5.3 |
| Water to make | 1.0 l | 1.0 l |
| pH | 10.00 | 10.05 |
| Bleaching Solution: | | |
| Ammonium 1,3-diaminopropane-tetraacetato ferrate.dihydrate | 160.0 | 290.0 |
| 1,3-Diaminopropanetetraacetic acid | 4.3 | 6.5 |
| Ammonium bromide | 200.0 | 300.0 |
| Ammonium nitrate | 30.0 | 50.0 |
| Acetic acid (98%) | 60 ml | 90 ml |
| Water to make | 1.0 | 1.0 l |
| pH | 4.2 | 3.3 |
| Fixing Solution: | | |
| 1-Hydroxyethylidene-1,1-di-phosphonic acid | 5.0 | 6.0 |
| Ammonium phosphite | 14.0 | 16.0 |
| Ammonia water (28%) | 3.0 ml | 5.0 ml |
| Aqueous solution of ammonium thiosulfate (70% w/v) | 330.0 ml | 360.0 ml |
| Water to make | 1.0 l | 1.0 l |
| pH | 6.7 | 7.4 |

| Stabilization solution: (for both tank solution and replenisher) | (g) |
|---|---|
| Formaldehyde (37%) | 1.2 ml |
| Triethanolamine | 2.0 |
| 5-Chloro-2-methyl-4-isothiazolin-3-one | 6.0 mg |
| 1,2-Benzoisothiazolin-3-one | 3.0 mg |
| Surfactant $[C_{10}H_{21}—O(CH_2CH_2O)_{10}H]$ | 0.4 |
| Ethylene glycol | 1.0 |
| Water to make | 1.0 l |
| pH | 5.0–7.0 |

Unexposed samples 101 to 108 were each processed with the above-given processing solutions already subjected to running processing. The amount of residual silver was determined by means of X-ray fluorescence analysis, and the fixing rate was evaluated for each sample (denoted "Processing A", hereinafter). Further, wedge-exposed samples were subjected to processing, so as to determine the sensitivity of the cyan layer for each sample. In this case, sensitivity is given as a relative value, taking as 100, the sensitivity of sample 101 at a density 0.2 higher than its minimum value.

The RMS value for each sample was similarly determined.

RMS value, which represents the graininess, was determined as follows. A sample having a cyan density of 0.5 was scanned with a microdensitometer having a scanner opening 48 μm in diameter, and the standard deviation for the variation in density was multiplied by 1,000.

In the running processing above, ferric complex of 1,3-diaminopropanetetraacetic acid and 1,3-diaminopropanetetraacetic acid used in the tank solution and the replenisher of bleaching solution were respectively replaced by equimolar amount of ferric complex of ethylenediaminetetraacetic acid and ethylenediaminetetraacetic acid, and by maintaining the other conditions unchanged, the same running processing was performed. Unexposed samples 101 to 109 were processed using the solution already subjected to a similar running process, and the amount of residual silver was measured on thus processed samples (denoted "Processing B", for comparison).

Then, each sample was exposed to light having a color temperature of 4800° K. at 10 CMS, and subjected to Processings A and B to observe the degree of bleaching. Samples subjected to Processing A were found to be completely bleached, whereas samples which underwent Processing B comprised at least 30 μg/cm² of residual silver indicating insufficient bleaching.

Table 8 gives the result obtained on unexposed samples.

TABLE 8

| Sample No. | Residual Silver (μg/cm²) Processing A | Processing B (For Comparison) | Relative Sensitivity | RMS Graininess | |
|---|---|---|---|---|---|
| 101 | 20 | 4 | 100 | 15 | Comparison |
| 102 | 9 | 4 | 101 | 13 | " |
| 103 | 5 | 5 | 102 | 12 | " |
| 104 | 4 | 5 | 102 | 11 | " |
| 105 | 19 | 4 | 100 | 15 | " |
| 106 | 4 | 4 | 102 | 12 | Present Invention |
| 107 | 3 | 5 | 103 | 11 | Present Invention |
| 108 | 2 | 5 | 103 | 10 | Present Invention |

Table 8 clearly reads that samples 104, 107, and 108 comprising silver halide grains according to the present invention exhibit higher rate of fixing in both Processings A (Processing in which bleaching solution comprising 1,3-DPTA.FE is used) and B (Processing in which bleaching solution comprising EDTA.Fe is used). Considering that samples 101 and 105 show extremely poor fixing in Processing A as compared with the fixing in Processing B, the result is rather surprising, and, further, improvement of graininess and sensitivity is an unexpected effect. Accordingly, it has been shown that both bleaching and fixing can be favorably effected only by applying the processing according to the present invention on a light-sensitive material comprising the emulsion of the present invention.

Fixing rate is further accelerated by the additional use of one of the compounds represented by general formula (I), more specifically, compound (17), as exemplified in samples Nos. 106 to 108, which shows higher fixing rate as compared with samples Nos. 102 to 104.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon one or more red-sensitive silver halide emulsion layers, one or more green-sensitive silver halide emulsion layers and one or more blue-sensitive silver halide emulsion layers, wherein the average silver iodide content of silver halide in all the silver halide emulsion layers is not less than 10 mol% and the silver halide color photographic material contains a compound represented by the following general formula (II) or (III):

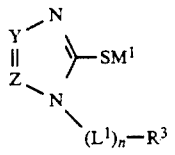

(II)

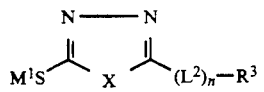

(III)

wherein Y and Z each represents a nitrogen atom or $CR^4$ (wherein $R^4$ represents a hydrogen atom, a substituted or unsubstituted alkyl group or a substituted or unsubstituted aryl group); $R^3$ represents $—SO_3M^2$ or $—COOM^2$ (wherein $M^2$ represents a hydrogen atom, an alkali metal, a quaternary ammonium or a quaternary phosphonium); $L^1$ represents a linking group selected from —S—, —O—,

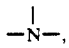

—CO—, —SO— and $—SO_2—$; n represents 0 or 1; $M^1$ represents a hydrogen atom, an alkali metal, a quaternary ammonium or a quaternary phosphonium; X represents a sulfur atom, an oxygen atom or

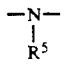

(wherein $R^5$ represents a hydrogen atom, a substituted or unsubstituted alkyl group or a substituted or unsubstituted aryl group); $L^2$ represents $—CONR^6—$, $—NR^6CO—$, $—SO_2NR^6—$, $—NR^6SO_2$, —OCO—, —COO—, —S—, $—NR^6—$, —CO—, —SO—, —OCOO—, $—NR^6CONR^7$, $—NR^6COO—$, $—OCONR^6—$ or $—NR^6SO_2RN^7—$ (wherein $R^6$ and $R^7$ each represents a hydrogen atom, a substituted or unsubstituted alkyl group or a substituted or unsubstituted aryl group);

wherein the silver halide photographic material has a total coating amount of silver from 3.0 to 8.0 g/m$^2$.

2. A silver halide color photographic material as claimed in claim 1, wherein the average silver idoide content of silver halide in all the silver halide emulsion layers is from 10.5 to 20.0 mol%.

3. A silver halide color photographic material as claimed in claim 1, wherein the average silver iodide content of silver halide in all the silver halide emulsion layers is from 11.0 to 15.0 mol%.

4. A silver halide color photographic material as claimed in claim 1, wherein the red-sensitive emulsion layer, green-sensitive emulsion layer and red-sensitive emulsion layer are each composed of two silver halide emulsion layers having different speeds respectively.

5. A silver halide color photographic material as claimed in claim 1, wherein the red-sensitive emulsion layer, green-sensitive emulsion layer and red-sensitive emulsion layer are each composed of three silver halide emulsion layers having different speeds respectively.

6. A silver halide color photographic material as claimed in claim 1, wherein at least one of the emulsion layers has an average silver iodide content of not less than 12 mol%.

7. A silver halide color photographic material as claimed in claim 1, wherein at least one of the emulsion layers has an average silver iodide content of not less than 14 mol%.

8. A silver halide color photographic material as claimed in claim 1, wherein at least two silver halide emulsion layers, containing silver halide emulsion grains in which silver iodobromide comprising from 15 to 45 mol% of silver iodide, exist in the form of a distinct stratified structure and the average silver iodide content in all grains is not less than 10 mol%.

9. A silver halide color photographic material as claimed in claim 1, wherein the silver halide grains are twin crystal grains having an aspect ratio of from 1.0 to 10.

10. A silver halide color photographic material as claimed in claim 1, wherein the silver halide grains have 50% or more of a (111) face.

11. A silver halide color photographic material as claimed in claim 1, wherein a total thickness of layers in the photographic light-sensitive material is from 13 to 25 μm.

12. A silver halide color photographic material as claimed in claim 1, wherein the heterocyclic group represented by Q in the general formula (I) is a member selected from the group consisting of an oxazole ring, a thiazole ring, an imidazole ring, a selenazole ring, a triazole ring, a tetrazole ring, a thiadiazole ring, an oxadiazole ring, a pentazole ring, a pyrimidine ring, a thiadine ring, a triazine ring, or a thiadiazine ring, or rings in which these rings are condensed with other carbon rings or hetero rings.

13. A silver halide color photographic material as claimed in claim 12, wherein the ring condensed with other carbon ring or hetero ring is selected from a benzothiazole ring, a benzotriazole ring, a benzimidazole ring, a benzoxazole ring, a benzoselenazole ring, a naphthoxazole ring, a triazaindolidine ring, a diazaindolidine ring, or a tetrazaindolidine ring.

14. A silver halide color photographic material as claimed in claim 1, wherein the organic group represented by $R^3$ is an alkyl group having from 1 to 20 carbon atoms or an aryl group having from 6 to 20 carbon atoms.

15. A silver halide color photographic material as claimed in claim 1, wherein a substituent for the alkyl group or aryl group represented by $R^3$, $R^4$, $R^5$, $R^6$ or $R^7$ is selected from a halogen atom, an alkoxy group, an aryloxy group, an alkyl group (when $R^3$ is an aryl group), an aryl group (when $R^3$ is an alkyl group), an amide group, a carbamoyl group, a sulfonamido group, a sulfamoyl group, a sulfonyl group, a sulfinyl group, a cyano group, an alkoxycarbonyl group, an aryloxycarbonyl group and a nitro group.

16. A silver halide color photographic material as claimed in claim 1, wherein the compound represented by the general formula (I) is present in a silver halide emulsion layer or an adjacent layer thereto.

17. A silver halide color photographic material as claimed in claim 8, wherein the stratified structure comprises a high iodine content part and a low iodine content part and wherein the ratio of diffraction intensity between the high iodine content part and the low iodine content part is in the range of 1/10 to 3/1.

18. A silver halide color photographic material as claimed in claim 8, wherein the stratified structure comprises a high iodine content part and a low iodine content part and wherein the ratio of diffraction intensity between the high iodine content part and the low iodine content part is in the range of 1/5 to 3/1.

19. A silver halide color photographic material as claimed in claim 8, wherein the stratified structure comprises a high iodine content part and a low iodine content part and wherein the ratio of diffraction intensity between the high iodine content part and the low iodine content part is in the range of 1/3 to 3/1.

20. A process for processing a silver halide color photographic material, which comprises processing the silver halide color photographic material of claim 1 with a bleaching solution containing ferric complex of 1,3-diaminopropanetetraacetic acid and processing thereafter with a solution having a fixing function.

21. A process for processing a silver halide color photographic material, which comprises color-developing the silver halide photographic material of claim 1 and processing thereafter with a bleach-fixing solution.

22. A process for processing a silver halide color photographic material as claimed in claim 21, wherein at least one selected from a group consisting of a compound represented by general formula (IV) below or a salt thereof is added to the bleach-fixing solution or to the prebath thereof:

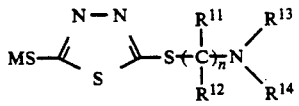

(IV)

wherein $R^{11}$ and $R^{12}$ each represents a hydrogen atom, a hydroxyl group, an amino group, a carboxyl group, a sulfo group or an alkyl group; $R^{13}$ and $R^{14}$ each represents a hydrogen atom, an alkyl group, or an acyl group, and $R^{13}$ together with $R^{14}$ may link to form a ring; M represents a hydrogen atom, an alkali metal atom, or an ammonium group; and n represents an integer from 2 to 5.

23. A silver halide color photographic material as claimed in claim 1, wherein said compound is according to general formula (II).

24. A silver halide color photographic material as claimed in claim 1, wherein said compound is according to general formula (III).

* * * * *